US006945781B2

(12) United States Patent
Perry et al.

(10) Patent No.: US 6,945,781 B2
(45) Date of Patent: Sep. 20, 2005

(54) INTEGRATED EVALUATION AND SIMULATION SYSTEM FOR ADVANCED NAVAL GUN SYSTEMS

(75) Inventors: John S. Perry, Afton, MN (US); Timothy W. Petersen, Burnsville, MN (US); Peter D. Clive, Blaine, MN (US); Charles S. Seum, Stillwater, MN (US); Douglas A. Knowles, Baltimore, MD (US)

(73) Assignee: United Defense, L.P., Arlington, VA (US)

( * ) Notice: Subject to any disclaimer, the term of this patent is extended or adjusted under 35 U.S.C. 154(b) by 395 days.

(21) Appl. No.: 10/115,148

(22) Filed: Apr. 2, 2002

(65) Prior Publication Data

US 2002/0192622 A1 Dec. 19, 2002

Related U.S. Application Data

(63) Continuation-in-part of application No. 09/824,512, filed on Apr. 2, 2001.

(51) Int. Cl.[7] ..... F31A 33/00

(52) U.S. Cl. ..... 434/11; 434/29; 703/13; 706/15; 706/45

(58) Field of Search ..... 434/11

(56) References Cited

U.S. PATENT DOCUMENTS

| | | | | |
|---|---|---|---|---|
| 5,661,668 A | | 8/1997 | Yemini et al. | |
| 5,719,797 A | | 2/1998 | Sevachko | |
| 6,106,298 A | * | 8/2000 | Pollak | 434/29 |
| 6,208,955 B1 | | 3/2001 | Provan et al. | |
| 6,411,945 B1 | | 6/2002 | Nakajima | |
| 6,567,087 B1 | * | 5/2003 | Reid | 345/428 |

OTHER PUBLICATIONS

Gallan, Jr, Roger D. , Analysis of UH–60 Black hawk Safety Controls Using Value Focused Thinking and Monte Carlo Simulation, Mar. 2000, Department of the Air Force Air University, pp. 1–131.*

Dubin, Henry; Sebastiani, Lambert; Staniec, Cyrus. High Performance Computing Workshop 1998 "Integrated Modeling and Slmulation into the US Army Operational Test and Evaluation Process" 1998, pp. 1–9. www.dtc.army.mil/hpcw/1998/sebast/sebast.html.*

(Continued)

*Primary Examiner*—Xuan M. Thai
*Assistant Examiner*—Cameron Saadat
(74) *Attorney, Agent, or Firm*—Patterson, Thuente, Skaar & Christensen, P.A.

(57) ABSTRACT

An integrated evaluation and simulation system for advanced naval gun systems interactively evaluates concept design decisions and design requirements in the context of a virtual representation of an operational advanced naval gun system. The combat effectiveness of an advanced naval gun system may also be concurrently tested by virtual simulation. A computer system is programmed to implement a causal network model comprising an integrated collection of analysis models for creating a virtual representation of an advanced naval gun system. The integrated evaluation and simulation system also includes a user interface operatively connected to at least the computer system, for selectively inputting data into the causal network model and receiving information therefrom, and preferably at least one virtual simulation system. The virtual simulation system may be operatively connected to the causal network model either directly as part of the computer system or indirectly through a virtual simulation system interface.

23 Claims, 18 Drawing Sheets

OTHER PUBLICATIONS

Carico, Dean. High Performance Computing Workshop 1998 "Flight Test Automation Using High Performance Computing" Naval Air Warfare Center Aircraft Division. 1998, pp. 1–9. www.dtc.army.mil/hpcw/1998/carico/carico.html.*

Allred, L.G. Aerospace and Electronics Conference, 1990. NAECON 1990., Proceedings of the IEEE 1990 National , May 21–25, 1990 Page(s): 359–361 vol. 1.*

Blankenship, Samuel. High Performance Computing Workshop 1998 "Physics–Based Models to Support Test and Evaluation", Test & Evaluation Research and Evaluation Center, 1998, pp. 1–9. www.dtc.army.mil/hpcw/1998/blanken/blanken.html.*

Anderson, Joseph A. "Structured Validation of Missile Systems", Sverdrup Technology, Inc. 1996, P. 553–556.*

* cited by examiner

IPS MONTE CARLO PARAMETERS

HELP PARAMETERS RESULTS

| (100 OF 100 RUNS) | MEAN | STD DEV | MIN | MAX |
|---|---|---|---|---|
| DERIVED IMPETUS (kJ/kg) | 1008.94 | 32.04 | 917.15 | 1076.25 |
| ROCKET FUEL Isp DERIVED (s) | 250.72 | 5.72 | 236.77 | 264.08 |
| ROCKET IGNITION TIME DERIVED (s) | 3.95 | 0.54 | 2.59 | 5.07 |
| CL MONTE CARLO FACTOR | 1.00 | 0.04 | 0.90 | 1.12 |
| CD MONTE CARLO FACTOR | 1.00 | 0.04 | 0.90 | 1.12 |
| MUZZLE VELOCITY (m/s) | 677.2224 | 7.8243 | 653.7719 | 693.0403 |
| MUZZLE ENERGY (MJ) | 23.09 | 0.53 | 21.52 | 24.18 |
| MAX RANGE (nmi) | 95.87 | 6.34 | 78.46 | 112.05 |
| ALT FOR MAX RANGE (m) | 30222.52 | 1190.68 | 26976.94 | 33210.29 |

*Fig. 6*

IPS MAIN

EXIT READ WRITE

PROJECTILE
- ◆GENERIC
- ◇RAYTHEON
- ◇SAIC

RESULTS DESIRED
- ☑INTERIOR BALLISTICS
- ☑SPECIFIC TOF
- ☑MAX RANGE
- ☐OVERALL TOF
- ☑LETHALITY

RUN CONTROL
- ◆SINGLE RUN ◇SENSITIVITY ◇MONTE CARLO
- NO. OF RUNS
- COMPUTE RESULTS

PARAMETER VALUES

◇TOF ◇PROJECTILE ◇ROCKET ◇CONTROL SURFACES ◇NOSE ◇WARHEAD ◇PROPELLANT ◆GUN ◇LETHALITY ◇AERO

GUN DESIGN PARAMETERS

| | |
|---|---|
| CALIBER (m) | 155.00 |
| MAX PRESSURE (MPa) | 310.270 |
| CHAMBER VOLUME (L) | 29.497 |
| TUBE LENGTH (cal) | 62.00 |
| MAX OUTSIDE DIAMETER (mm) | 381.00 |
| MIN OUTSIDE DIAMETER (mm) | 241.30 |
| GUN MATERIAL DENSITY (kg/m^3) | 7850.10 |
| BREAK POINT 1 (cal) | 22.9420 |
| BREAK POINT 2 (cal) | 56.1006 |
| DESIGN RATE OF FIRE (RPM) | 10.00 |

GUN COMPUTED PARAMETERS

| | |
|---|---|
| GUN TRAVEL (cal) | 54.400 |
| GUN CHAMBER LENGTH (cal) | 7.6000 |
| GUN MASS (kg) | 4982.77 |
| GUN INERTIA (kg*m^2) | 101146.02 |
| GUN UNBALANCED (N*m) | 193329.34 |
| DERIVED RATE OF FIRE (RPM) | 10.00 |

100

*Fig.14*

IPS MAIN

EXIT READ WRITE

PROJECTILE
- ◇GENERIC
- ◇RAYTHEON
- ◇SAIC

RESULTS DESIRED
- ☑ INTERIOR BALLISTICS ☑SPECIFIC TOF
- ☑ MAX RANGE ☐OVERALL TOF
- ☑ LETHALITY

RUN CONTROL
◇SINGLE RUN◇SENSITIVITY◇MONTE CARLO

NO. OF RUNS

COMPUTE RESULTS

PARAMETER VALUES

TOF | GUN | PROPELLANT | PROJECTILE | NOSE CONE | ROCKET | WARHEAD | FINS | AERO | LETHALITY

SHOT DEFINITION

| | |
|---|---|
| MISSION ITERATIONS | 5 |
| NUMBER OF SHOTS | 12 |
| FIRING RANGE (SHOTS/MINUTE) | 12.0 |
| SLOP TIME (SECS) | 0.0000 |
| TYPE OF MISSION ◇ MRSI ◇ NON-MRSI | |
| SHEAF ◇ OPEN ◇ CONVERGED | |
| SUB DISPERSAL RADIUS (m) | 30.00 |
| SUB DISPERSAL RADIUS SIGMA (m) | 5.0 |
| TIME OF FALL (SEC) | 20.0 |
| TIME OF FALL SIGMA (SEC) | 5.0 |
| MPI RANGE ERROR (m) | 0.0 |
| MPI DEFLECTION ERROR (m) | 0.0 |
| PRECISION RANGE ERROR (m) | 0.5 |
| PRECISION DEFLECTION ERROR (m) | 0.5 |

TARGET AREA DEFINITION

TARGET RANGE SET IN MIN/MAX TOF

| | |
|---|---|
| TARGET AREA LENGTH (m) | 400.00 |
| TARGET AREA WIDTH (m) | 100.0 |
| TARGET AREA ORIENTATION (deg) | 0.0 |
| OBSERVER POSITION ERROR (m) | 25.0 |
| OBSERVER ORIENTATION ERROR (deg) | 5.0 |

TARGET DEFINITIONS

STANDING PERSONNEL

| | |
|---|---|
| LETHAL AREA | 300.0 |
| HARDENING:◇ENABLED◇DISABLED | |
| HARDENED LETHAL AREA | 20.0 |
| MIN TIME TO HARDEN (SEC) | 3.0 |
| MAX TIME TO HARDEN (SEC) | 7.0 |
| POSITIONING:◇FIXED◇RANDOM | |
| SUBTARGETS | 100 |
| REACTION:◇ENABLED◇DISABLED | |
| MIN TIME TO REACT (SEC) | 0.5 |
| MAX TIME TO REACT (SEC) | 4.0 |
| ACCELERATION | 1.00 |
| VELOCITY | 0.00 |
| BEARING:◇FIXED◇RANDOM | |
| BEARING (deg) | 0.0 |

REMOVE THIS TARGET

108

INTEGRATED EVALUATION AND SIMULATION SYSTEM FOR ADVANCED NAVAL GUN SYSTEMS

RELATED APPLICATIONS

This application is a continuation-in-part application of a co-pending nonprovisional application, Integrated Evaluation and Simulation System for Military Weapon Systems, Ser. No. 09/824,512, filed Apr. 2, 2001, and incorporated herein by reference.

FIELD OF THE INVENTION

The present invention relates generally to the field of simulating military weapon systems. In particular, the present invention relates to a system for use in conjunction with designing complex military weapon systems, by performing sophisticated design concept analyses and by simulating operations on virtual representations of advanced naval gun systems interactively with the design work.

BACKGROUND OF THE INVENTION

The development of complex military equipment traditionally has been based on a rigid, top-down approach, originating with a publication of a customer operational requirements document. A prime contractor decomposes the operational requirements document to allocate requirements across the weapon system level, which in turn are further decomposed and allocated across the subsystem and component levels. This top-down, hierarchical approach ensures that customer requirements are reflected in lower-level components and become integral to an objective weapon system design. This approach, however, does very little to optimally allocate limited resources across a weapon system design, and objective characteristics of an operational design often exceed program constraints. In addition to suboptimized designs, the top-down approach often leads to misallocated development resources and development processes that are incapable of rapidly responding to inevitable changes in operational, fiscal, and technological considerations.

Customer recognition of the above-described dilemmas, the realities of tight fiscal budgets, and changes in the geopolitical climate during the past decade have had a noticeable philosophical effect on how future weapon systems will be developed and procured. The development of future weapon systems will be cost constrained so that a weapon system's capabilities will be partially determined by a customer's ability to procure funding. In addition, most forces are no longer forward deployed, but instead are forward deployable. The ability to project force around the world, and the ability to sustain a force outside a customer's sovereign territory, has placed a tremendous burden on the logistical and tactical operations of customers. With respect to naval gun systems involved in indirect fire engagement, ships must be capable of rapidly reaching a destination or target area and engaging in a live fire exercise with limited collateral damage to a civilian population and structures nearby the targets. Moreover, sequentially fired munitions or munitions fired from multiple guns must be capable of reaching a target area as a coordinated delivery for maximum combat effectiveness.

Because of these fiscal and geopolitical changes, some customers have established a mission need and a partial list of non-negotiable, operational requirements for future weapon systems. These customers also have requested prospective weapon system developers to design, develop, and demonstrate credible simulated modeling approaches to satisfying operational weapon system requirements and to developing weapon system designs that allocate constrained resources while optimizing performance according to specified measures of effectiveness.

Previous efforts to develop software for weapon systems have focused on stand alone simulation software or software that provides analysis at the subsystem or component level only, because methods such as the above-described top-down approach were used to manage the overall design and development process. For example, R. Carnes et al., U.S. Pat. No. 4,926,362, Airbase Sortie Generation Analysis Model (ABSGAM), describes a computer simulation model for analyzing the sortie generation capabilities and support requirements of air vehicle designs and for performing effectiveness analyses on these designs. The model cannot be used to allocate resources across a system or various subsystems or components of a design nor used concurrently and interactively with design work. Another similar invention is described by R. Adams, U.S. Pat. No. 5,415,548, System and Method for Simulating Targets for Testing Missiles and Other Target Driven Devices.

It would be advantageous to have an evaluation and simulation system that functions integrally and interactively with the conceptualization, design, and development of weapon systems, and particularly advanced naval gun systems, under conditions whereby design concepts can be analyzed, constrained resources can be allocated across a weapon system architecture in a manner that optimizes the weapon system's combat effectiveness, and a virtual representation of the weapon system can be tested under simulated combat conditions for combat effectiveness. Moreover, it would be advantageous if a user of such an evaluation and simulation system could establish performance levels for operational, system, subsystem, and component requirements while optimizing the advanced naval gun system's effectiveness and satisfying the resource constraints.

SUMMARY OF THE INVENTION

An integrated evaluation and simulation system for advanced naval gun systems interactively evaluates concept design decisions and design requirements in the context of a virtual representation of an operational advanced naval gun system. The combat effectiveness of an advanced naval gun system may also be concurrently tested by virtual simulation. A computer system is programmed to implement a causal network model comprising an integrated collection of analysis models for creating a virtual representation of an advanced naval gun system. The integrated evaluation and simulation system also includes a user interface operatively connected to at least the computer system, for selectively inputting data into the causal network model and receiving information therefrom, and preferably at least one virtual simulation system. The virtual simulation system may be operatively connected to the causal network model either directly as part of the computer system or indirectly through a virtual simulation system interface.

Preferred embodiments of the present invention relate to an integrated evaluation and simulation system for advanced naval gun systems for concurrently and interactively evaluating the benefits and burdens of concept design decisions and design requirements with design work. The combat effectiveness of an naval gun system built according to a set of design parameters also can be concurrently tested by virtual simulation. Thus, the present invention enables system designers to efficiently, comprehensively, interactively, and concurrently evaluate and optimize overall naval gun system performance by manipulating basic system design inputs and parameters. The invention is easily adapted to a wide variety of analyses, including single step analysis, dependencies analysis, sensitivity and trade-off analysis, Monte Carlo analysis, and optimization analysis based on predetermined input parameters and resource constraints.

Preferred embodiments of the integrated evaluation and simulation system for advanced naval gun systems include a computer system programmed to implement a computational engine having at least one causal network model factoring at least one interrelationship among a plurality of critical, advanced naval gun system combat effectiveness functional attributes and constrained resources, and programmed to create a virtual representation of a naval gun system. The computational engine implements a modular software architecture down to the gun system's component level, so that each module can be represented by a separate subroutine. Preferred embodiments also include a user interface operatively connected to at least the computer system to selectively input data into and receive information from the computational engine, and preferably include at least one virtual simulation system operatively connected to the computational engine to simulate an naval gun system. The user interface may have a menu driven graphical user interface with a display feature for depicting a two- or three-dimensional view or picture of the virtual representation of the naval gun system. The computer system may communicate with the at least one virtual simulation system and receive information from the virtual simulation system in other ways to be described herein.

The combat effectiveness functional attributes of an advanced naval gun system include the attributes of gun composition, propellant characteristics, projectile composition, aerodynamic characteristics of the projectile, and lethality. Gun composition includes parameters related to the gun barrel such as physical characteristics, assembly, and performance. Projectile characteristics includes parameters related to the ammunition, such as nose cone, rocket motor, warhead, and control surface characteristics, general projectile characteristics, and guidance. The effects of these attributes can be observed by running a simulation on proprietary virtual environment software or software that is governmentally or commercially available.

Preferred embodiments of the integrated evaluation and simulation system are based on several performance criteria: system usability, system modularity, system speed, and system accuracy. Usability is defined as the level of accessibility to input data and output information, and the level of user friendliness of the user interface design. All input and output is accessible to a user via a graphical user interface and/or data files. A user is not encumbered with "window confusion," i.e., having too many windows open simultaneously, as preferred embodiments allow for no more than six windows to be open concurrently.

The integrated evaluation and simulation system is easy to maintain and upgrade because of its modular software design. Preferred embodiments use a modular subroutine for each "node" within the causal network model to facilitate the maintenance, removal, and replacement of each "black-box" for each node, as the need arises, without disrupting the balance of the system.

Computational speed is defined for each mode of operation in terms of execution on currently available UNIX Silicon Graphics workstations. In the single-run mode, which involves propagating all inputs through the causal network model and into a virtual simulator, 2 minutes or less is required. In the dependencies mode, a run time of less than 10 seconds is required. In the sensitivities mode, a run time of 2 minutes or less is required for each increment of the independent variables. In the Monte Carlo mode, a run time of 2 minutes of less is required for each random variable selection. In the optimization mode, a run time of 1 hour or less for 6 independent variables is acceptable, and a run time of 2 days or less is acceptable for global optimization. These times are established for output having a computational error that does not exceed a predetermined percentile for any single computed variable, presently ten percent, when compared to actual test data.

The present invention also includes a method of integrated evaluation and simulation for determining design parameters and allocating resources across a system architecture of an advanced naval gun system to optimize the gun system's combat effectiveness, by providing a computer system having a user interface and a computational engine having a causal network model factoring an interrelationship among a plurality of critical combat effectiveness functional attributes and constrained resources for the gun system; by providing at least one virtual simulation system; by selectively inputting data into the computational engine to create a virtual representation of an optimally effective naval gun system; by selectively running the virtual representation of the optimally effective naval gun system in the at least one virtual simulation system; and by utilizing information obtained from the simulation run to enhance the virtual representation of the optimally effective naval gun system.

The computer system alternatively can be described as having a computer-readable storage media storing at least one computer program that operates as an integrated evaluation and simulation system for determining design parameters and allocating resources across a system architecture of an advanced naval gun system to optimize the naval gun system's combat effectiveness. This implementation is accomplished by storing a computational engine having a causal network model factoring at least one interrelationship among a plurality of critical combat effectiveness functional attributes and constrained resources in the computer system; by obtaining data necessary for the program to create a virtual representation of an optimally effective naval gun system; by running the computational engine to create the virtual representation of the optimally effective naval gun system; by selectively sending the virtual representation to a virtual simulation system for simulating an operation of the naval gun system; and by receiving information from the virtual simulation system about the simulated operation of the naval gun system.

BRIEF DESCRIPTION OF THE FIGURES

FIG. 6 is a panel or window display of gun design input parameters performance requirements, and gun computed parameters.

FIG. 14 is a panel or window display of lethality input performance requirements.

DESCRIPTION OF THE PREFERRED EMBODIMENT

The preferred embodiment of the present invention implements an integrated evaluation and simulation computer system for assisting system designers of advanced naval gun systems to select values for correlated design parameters and performance requirements and to allocate limited resources across a system architecture of a naval gun system. By establishing design input parameters and performance requirements for operational, system, subsystem, and/or component levels, users of the integrated evaluation and simulation system can determine optimal equipment designs, as measured by naval gun systems' combat effectiveness and given resource constraints. The integrated evaluation and simulation system also is capable of concurrently and interactively modeling the performance of a naval gun system by simulating the naval gun system's combat effectiveness in a virtual simulation system. The integrated evaluation and simulation system implements a modular software architecture down to the equipment component level and can be operated by selectively using a menu driven graphical user interface.

Figure 1:
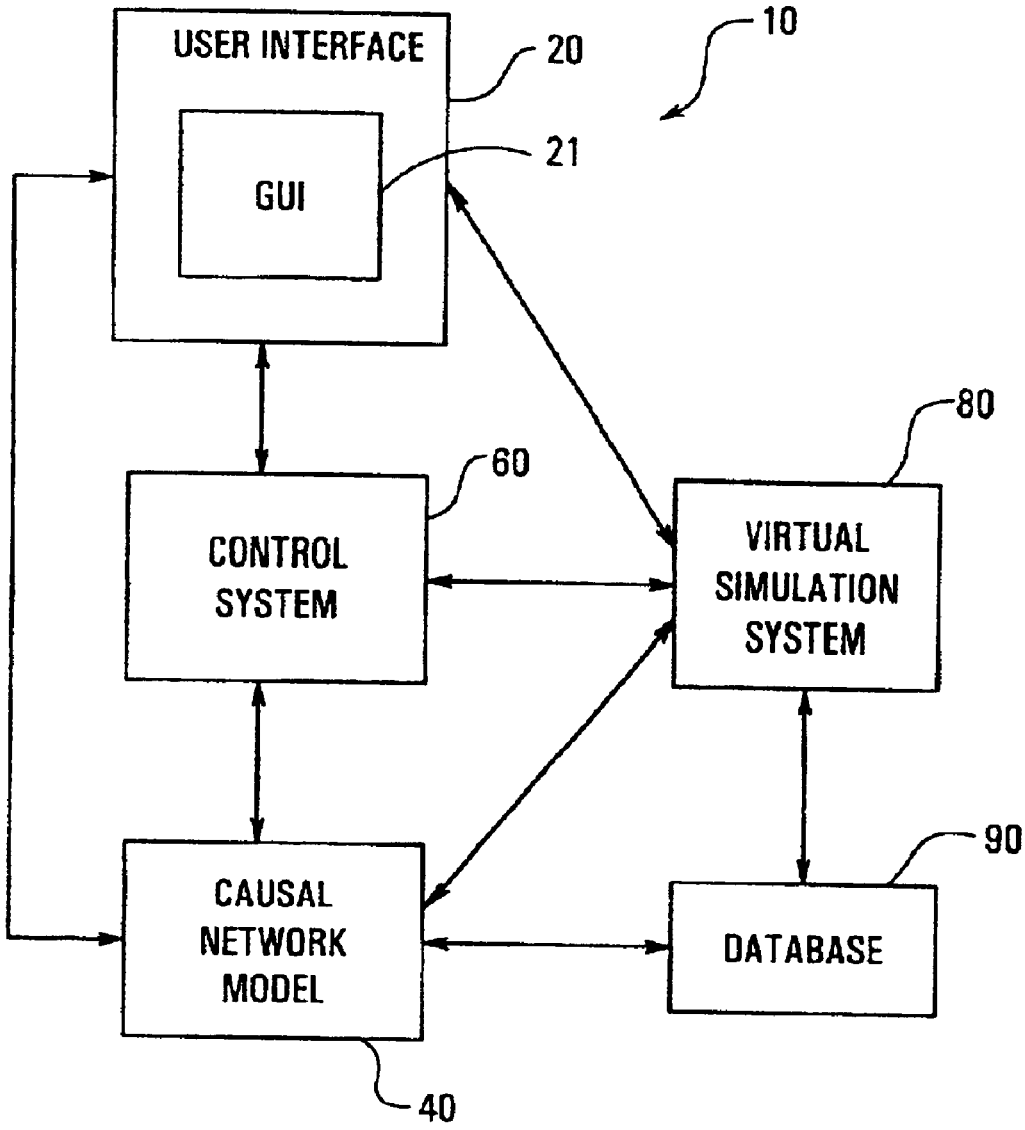
FIG. 1 is a diagram of the system architecture of the integrated evaluation and simulation system.

As shown in FIG. 1, a system architecture 10 of the present invention includes a user interface 20 having a graphical user interface 21, a causal network model 40, a control system 60, at least one virtual simulation system 80, and a database 90. The causal network model 40 and controller system 60 integrally comprise what is referred to as a computational engine of the advanced naval gun system embodiment. The virtual simulation system 80 is built into the computer system; however, a virtual simulator system interface may be used to bridge to a third party virtual simulation system. The database 90 is operatively connected to at least the computational engine and the virtual simulation system 80. Preferably, the user interface 20 bi-directionally communicates with the causal network model 40 and the virtual simulation system 80, the causal network model 40 bi-directionally communicates with the control system 60 and the virtual simulation system 80, and the control system 60 bi-directionally communicates with the virtual simulation system 80 and the user interface 20.

Figure 2:
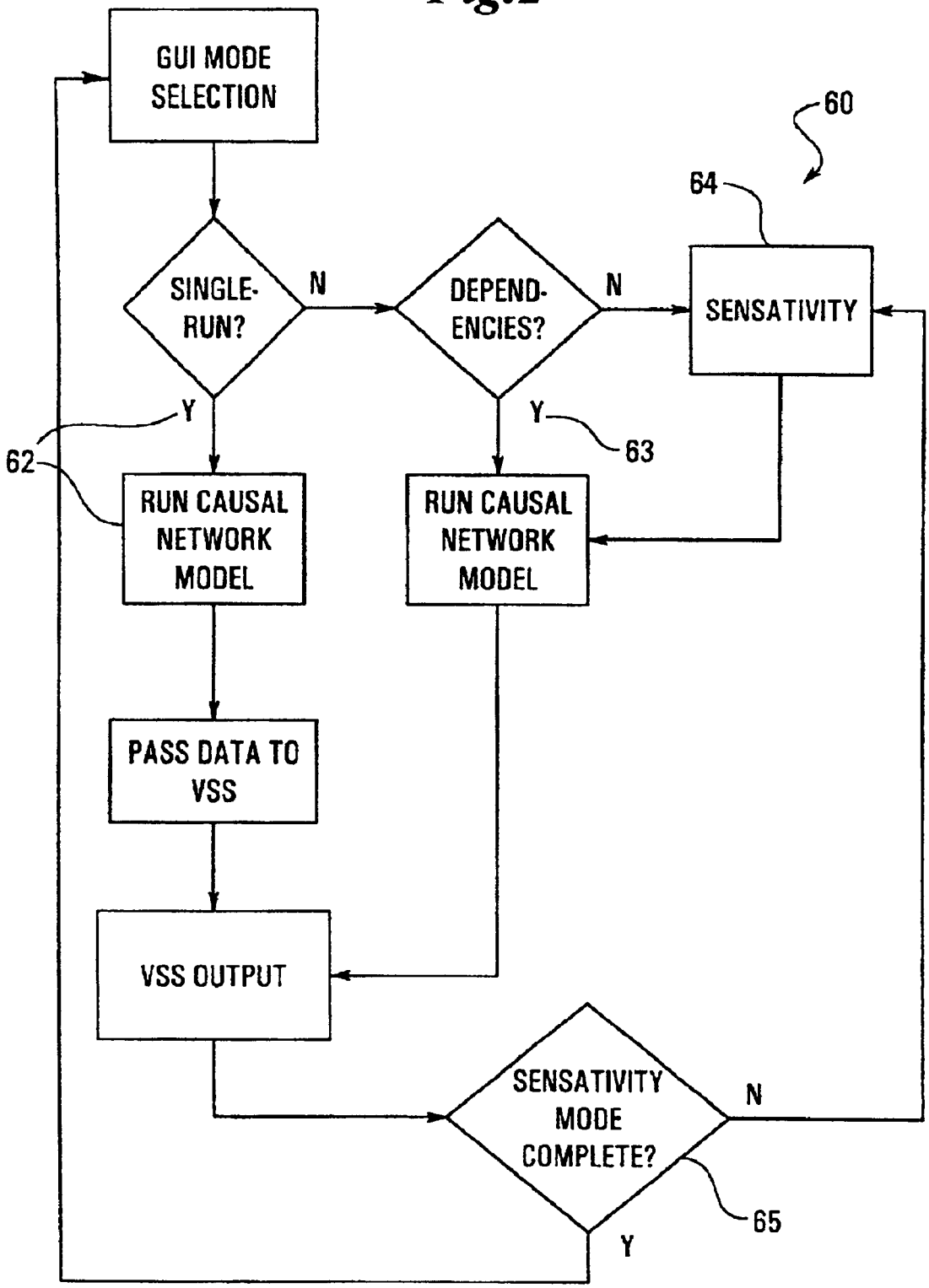
FIG. 2 is a diagram of the control system algorithm of the preferred embodiment.

The control system 60 is used to control the states and modes of operation of the invention and to control the optimization process that operates upon the causal network model 40. The control system 60 is preferably at least partly based on gradient search methodology, and the optimization process may be a commercially available product. Preferably, the integrated evaluation and simulation system can run in any of five different modes: a single-run mode for propagating specified inputs once through the causal network model; a dependencies mode for identifying all parameters downstream from any input parameter; a sensitivities mode for providing a venue for performing sensitivity and trade-off analysis between any variables within the causal network model; a Monte Carlo mode for including technological and manufacturing uncertainty in an analysis; and an optimization mode for optimizing a weapon system's combat effectiveness at a local or global level, i.e., a component, subsystem, or system level. The integrated evaluation and simulation system also can perform sensitivity analyses between a weapon system's operational performance and a system, subsystem, or component input parameter; design attributes; or performance requirement. A control system algorithm 61, as illustrated in FIG. 2, controls the integrated evaluation and simulation system 10 in the single-run, dependencies, and sensitivities modes of operation. The Monte Carlo mode performs random drawings on specified parameters, performs a single run for each drawing, and collects the statistics. The optimization mode is achieved by using special algorithms to pulse the causal network model 40 until each of the dependent variables converge to within acceptable limits, presently ten percent of actual values.

The single-run mode (at step 62) performs a single run or iteration through the causal network model 40, producing a set of intermediate and final results. Input variables can be changed one at a time or in any combination. This mode finds a point solution for a given set of input parameters and/or requirements and displays the results requested by a user, such as interior ballistics, maximum range, lethality, minimum and maximum time of flight for a specified range, and minimum and maximum time of flight at each target altitude above sea level, and each range at each quadrant elevation. The computational process begins when a run button is activated to propagate all of the input data through the entire causal network model 40.

The dependencies mode (at step 63) rapidly and visually identifies the interrelationships between design and performance parameters within the causal network model 40. A user can select any input value and generate visual cues, for example check boxes, of all downstream parameters that would be affected by a change to this input. First, the control system 60 is initiated and the causal network model 40 is pulsed to identify the downstream parameters. Then the results are returned to the user interface 20.

The sensitivities mode (at steps 64 and 65) is designed to evaluate weapon system performance in terms of any design parameter in the causal network model 40. When this mode is selected, any input design parameter can be varied over a specified range to evaluate the effects on any performance parameter. The control system 60 performs multiple single-run passes through the causal network model 40, varying the input to analyze each variation or combination of selected input parameters according to a range and/or increment specified by the user, and the results are displayed and stored as they are generated. The results of the analysis are presented in an analysis window and can be displayed graphically. This mode allows for brute force search of a number of design parameters to determine their effect on the overall system. It is also an alternative means of optimization, by running a sensitivity analysis and inspecting the results by sight.

Figure 3:
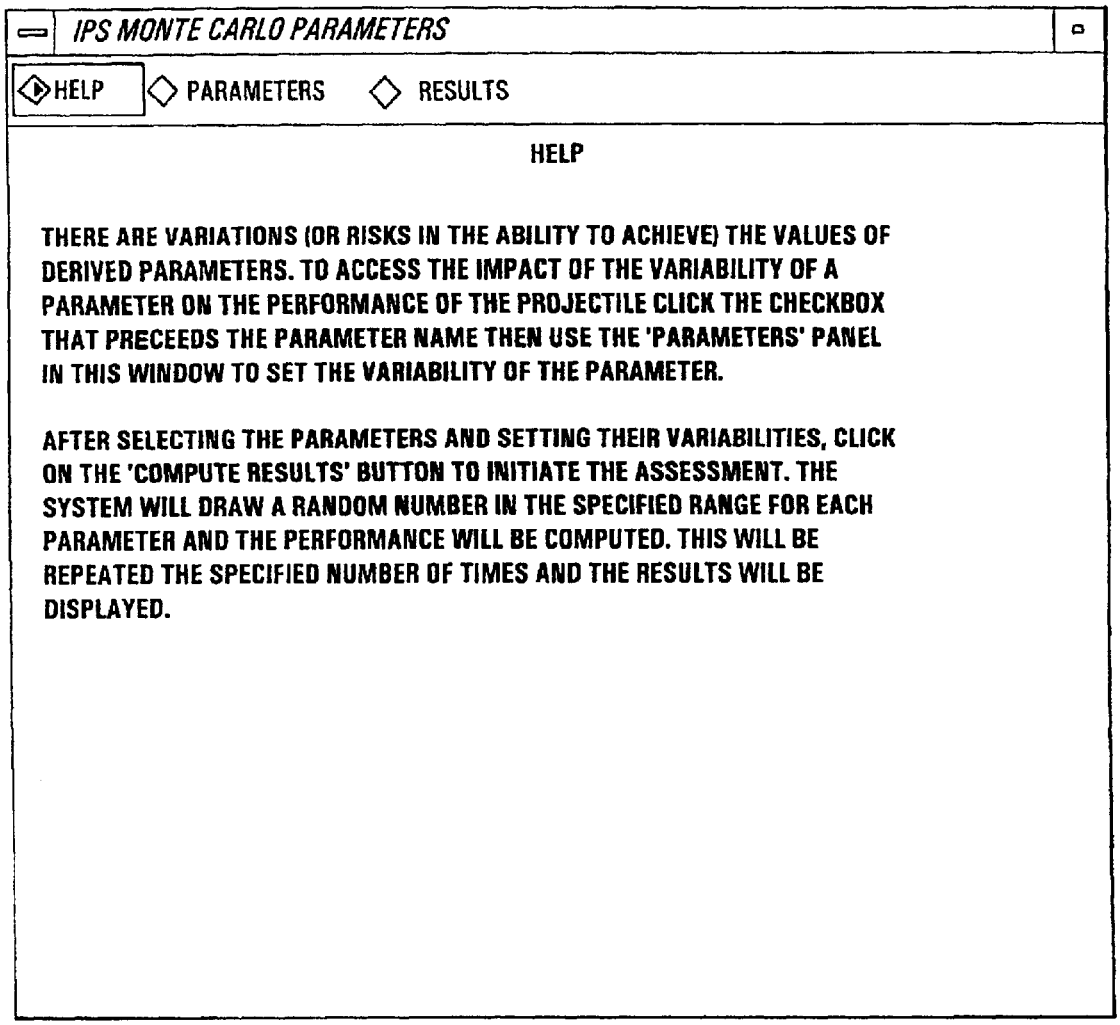
FIG. 3 is a help panel or window display for the Monte Carlo analysis mode.
Figure 4:
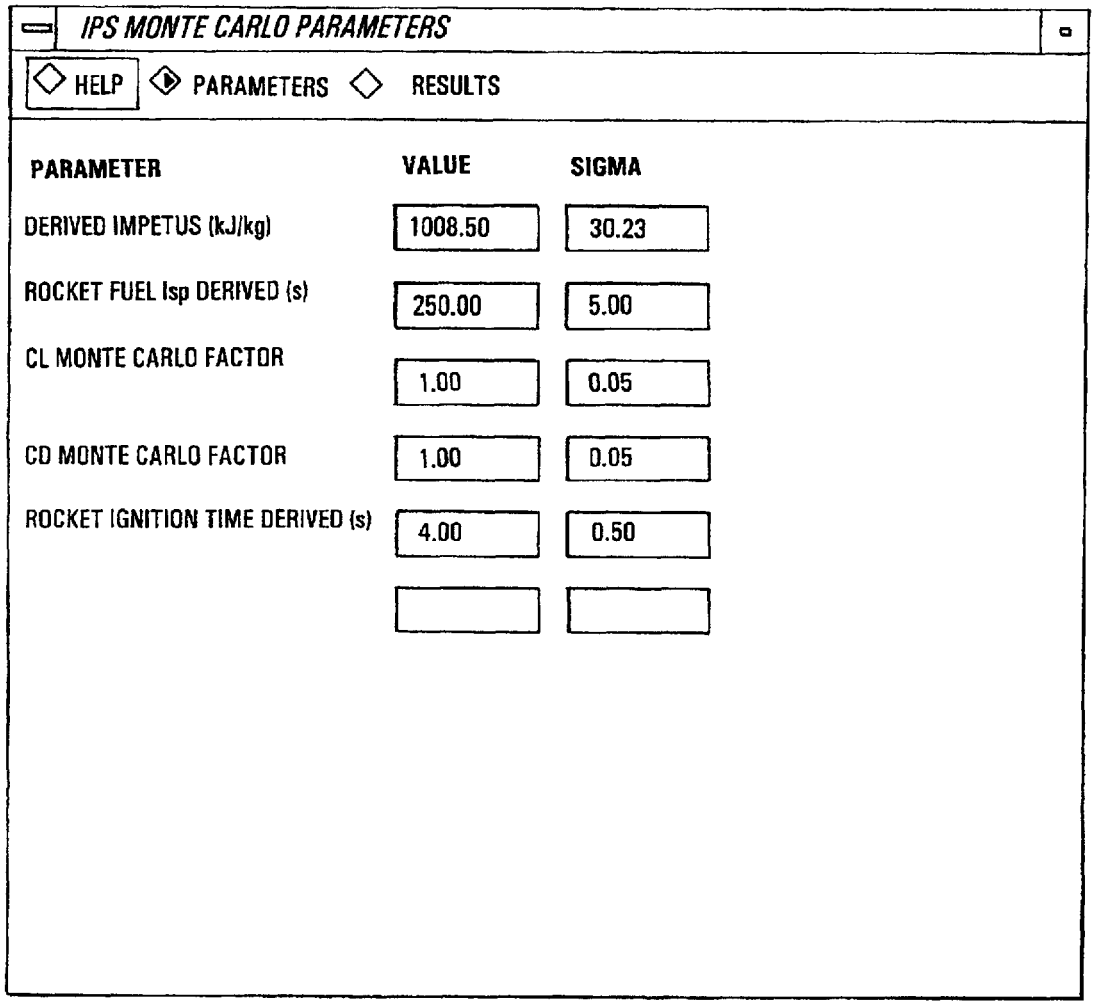
FIG. 4 is a parameter input panel or window display for the Monte Carlo analysis mode.
Figure 5:
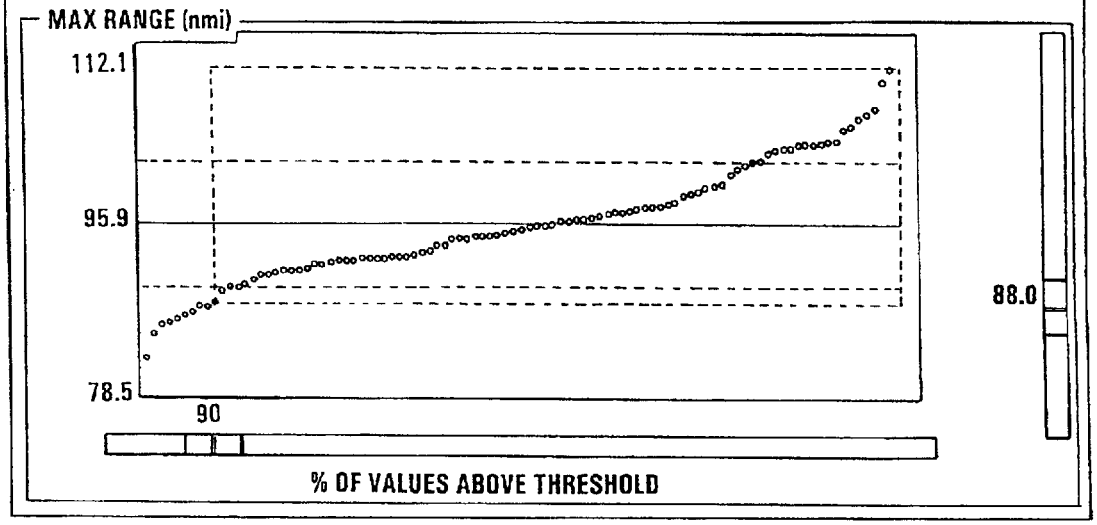
FIG. 5 is a results panel or window display of a Monte Carlo analysis mode run.

The Monte Carlo mode allows a user to insert technological and manufacturing uncertainty into an analysis to assess a probability of meeting specified requirements. The concept is similar to the sensitivities mode but can work with computed or derived parameters including intermediate parameters. This mode allows a user to vary parameters by specifying their means and standard deviation sigmas. The code performs a random draw on each of the selected parameters and then executes the equivalent of a single run. Statistics are collected on the parameters and the results. As shown in FIGS. 3 through 5, the Monte Carlo mode has three window displays, a help window providing user instructions, a parameters window for entering values and sigmas, and a results window showing the outcome of a Monte Carlo run. The results window provides the mean, standard deviation, and the minimum and maximum outcomes for derived values used in the Monte Carlo run as well as muzzle velocity, muzzle energy, maximum range in nautical miles, and maximum range in meters results. The results window also includes a graph display for graphing each of the results by clicking on or highlighting the respective line, and the graph display scales can be adjusted to better view certain areas of a graph.

The optimization mode provides for determining the best mix of design parameters that meet specified performance requirements and resource constraints while optimizing a naval gun system's combat effectiveness as measured, for example, by lethality. A user can select which design parameters will be included in an optimization. These selections are used to configure the control system 60 to optimize combat effectiveness by varying the selected design parameters and satisfying the resource constraints and performance requirements.

Figure 18:
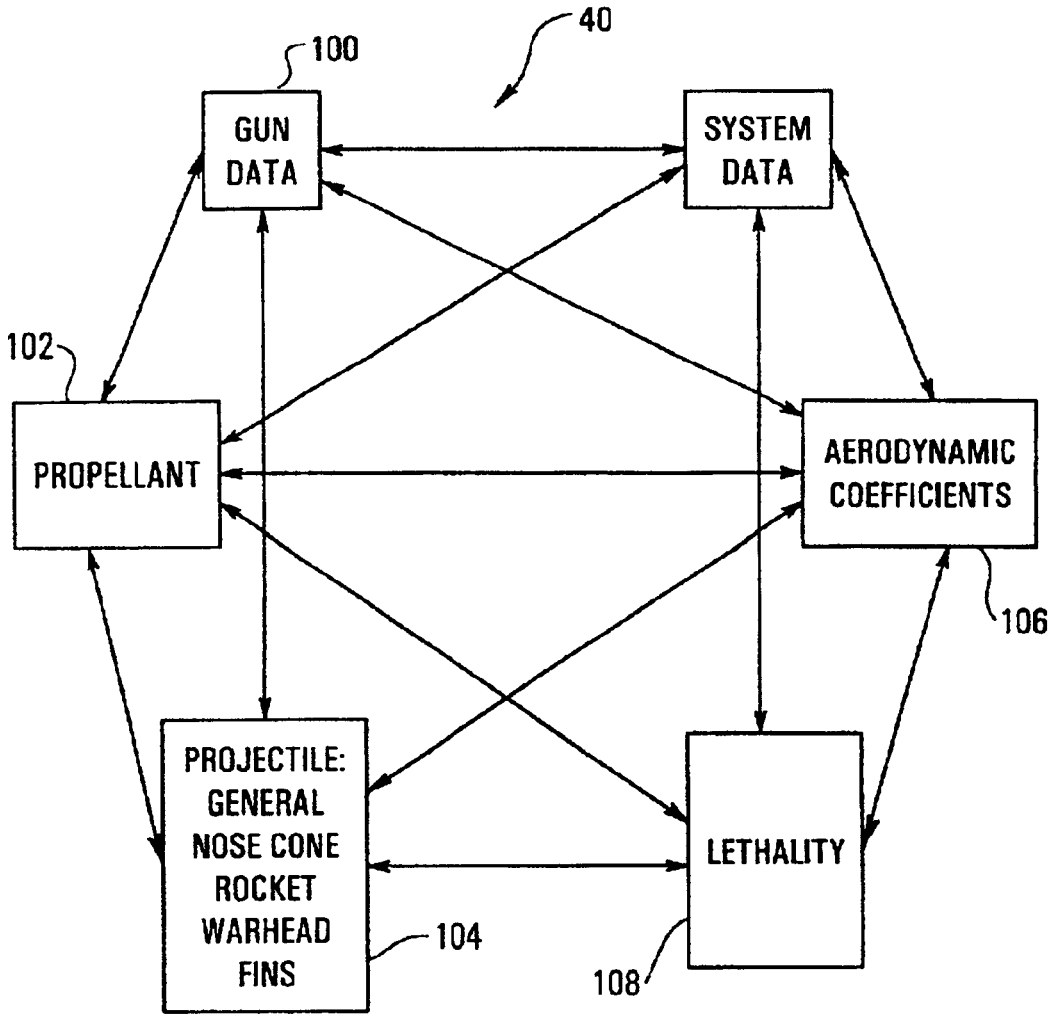
FIG. 18 is a depiction of the causal network model.

The causal network model 40 integrates lower level design algorithms with higher-level mission effectiveness simulation results so that system designers or analysts can modify any portion of a gun, magazine, or projectile design and assess the modification's impact on all other areas of a gun system. In addition, the causal network model can be used to evaluate a system design and for test support of specific contractor projectiles or other equipment. The causal network model 40 performs all the computations required by the user interface 20 and the control system 60, and provides a means for analyzing complex interactions and interrelationships among parameters and constraints within the naval gun system under study. As shown in FIG. 18, the preferred embodiment of the causal network model is implemented around five combat effectiveness functional attributes, each related to a particular part of the naval gun system. These attributes are gun composition or data 100, propellant characteristics or data 102, projectile composition or data 104, aerodynamic characteristics or data of the projectile 106, and lethality data 108. Each functional attribute is implemented to a level that supports an assessment of performance and the constrained resources. The causal network model 40 creates a virtual representation of the naval gun system under study that encompasses the critical combat effectiveness functional attributes of the gun system. The causal network model is highly modular.

The gun data 100 has a barrel physical model for calculating the performance parameters of a gun barrel. As shown in FIG. 6, gun design input parameters and performance requirements include caliber, maximum pressure, chamber volume, tube length, maximum outside diameter, minimum outside diameter, gun material density, barrel break points or slope changes, and designed rate of fire. Gun computed or performance or dependent parameters include gun travel, gun chamber length, gun mass, gun inertia, gun unbalance, and derived rate of fire. The causal network model and supporting database store tables, equations, and/or other information relating to gun data, including barrel data, assembly data, and performance data. Barrel data includes data such as caliber, outer barrel diameter, break points, slopes, mass, inertia, center of gravity, chamber volume, maximum pressure, total length, chamber length, travel, material strength and density, target wear life, target fatigue life, and actual fatigue life of a gun barrel. Assembly data includes data such as gun mass, inertia about the attachment point, center of gravity, gun length, drive peak power, position, and motion characteristics including type of motion, velocity, acceleration, limits, and commands for motions. Performance data includes data such as bore resistance; muzzle velocity for each projectile; wear rate for each projectile; number of rounds, firing rate, number of bursts, and wait between bursts for a live fire scenario; number of quadrant elevations, quadrant elevations; firing rate at each quadrant elevation; and peak power.

Figure 7:
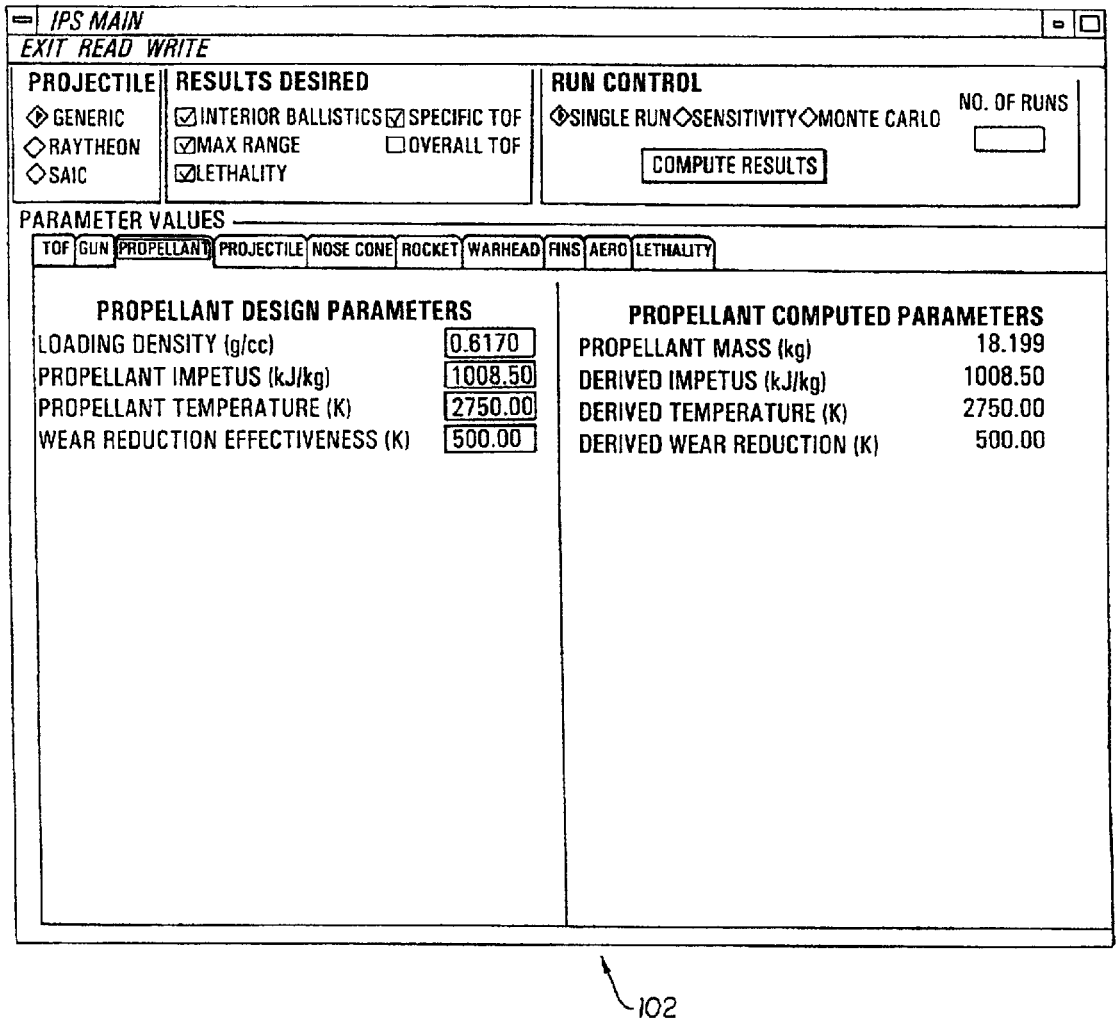
FIG. 7 is a panel or window display of propellant design input parameters performance requirements, and propellant computed parameters.

The propellant data 102 combines the gun chamber volume input with the designed loading density to generate a propellant mass. As shown in FIG. 7, propellant design input parameters and performance requirements include loading density, propellant impetus, propellant temperature, and wear reduction effectiveness. Propellant computed or performance or dependent parameters include propellant mass; derived impetus; derived temperature; and derived wear reduction. The causal network model and supporting database store tables, equations, and/or other information relating to propellant data, including loading density; mass; maximum service pressure; impetus; flame temperature; covolume; density; specific heat ratios, grain diameter, length, perforation diameter, number of perforations, burning rate, and deterrent; temperature reduction; igniter mass, impetus, and flame temperature; and case mass.

Figure 8:
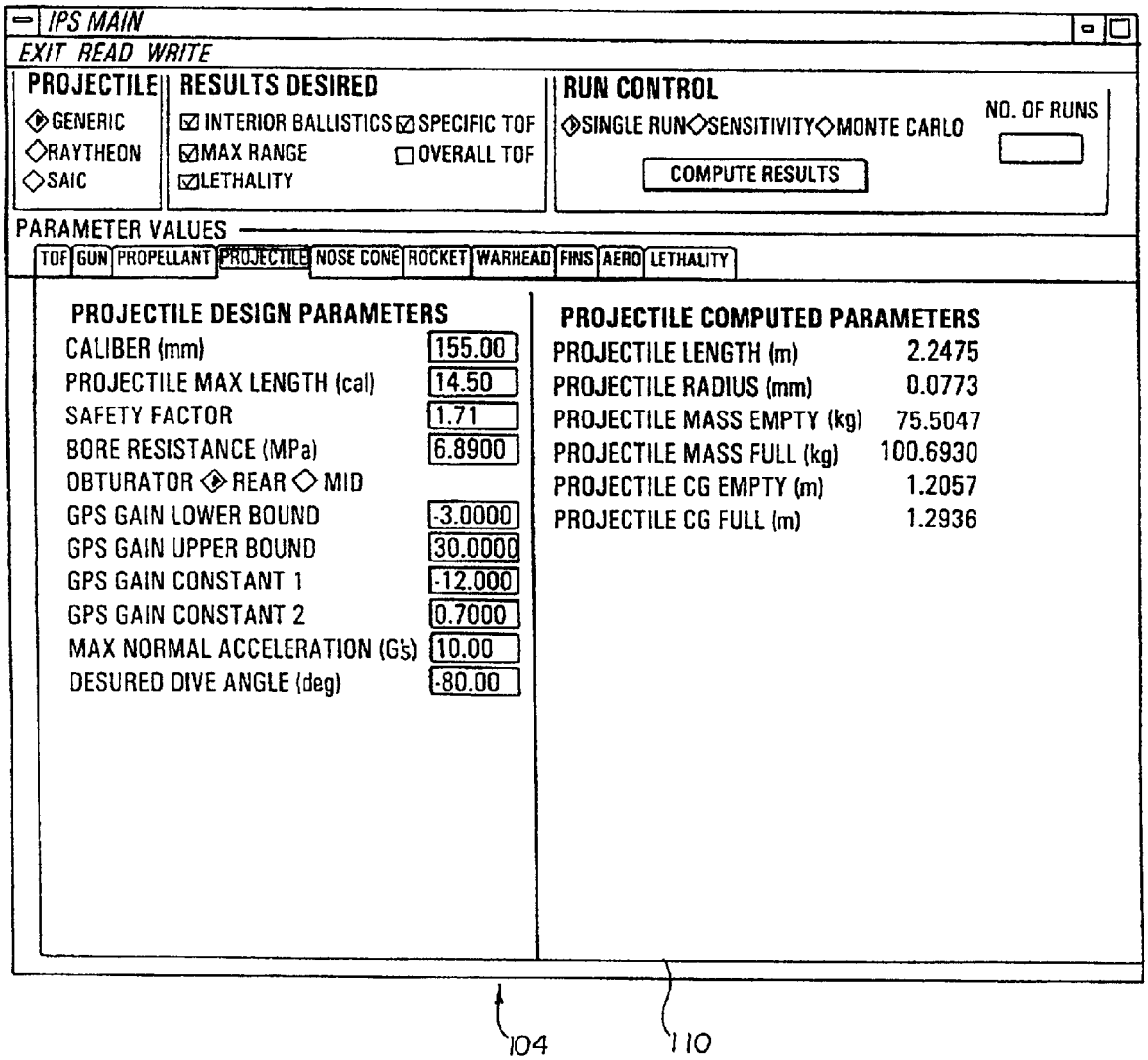
FIG. 8 is a panel or window display of projectile design input parameters performance requirements, and projectile computed parameters.

The projectile data 104 contains models relating to physical properties of a projectile. The design parameters and performance requirements for nose cones, control surfaces, rocket motors, and warheads as well as for general projectile features are combined with the designed breech pressure and charge-to-mass ratio to iterate to a solution that yields physical properties of a projectile. As shown in FIG. 8, projectile design input parameters and performance requirements are subdivided into the above named five areas of general projectile data 110, nose cone data 112, rocket data 114, warhead data 116, and control surfaces or fins data. Design input parameters and performance requirements for general projectile data 110 include caliber, projectile maximum length, structural safety factor, bore resistance, choice of rear or mid projectile location for at least one obturator, guidance navigation and control terms, maximum normal acceleration, and desired dive angle. Projectile computed or performance or dependent parameters include projectile length, projectile radius, projectile mass when empty, projectile mass when full, projectile center of gravity when empty, and projectile center of gravity when full. The causal network model and supporting database store tables, equations, and/or other information relating to general projectile data, including mass for both a full and empty projectile, center of gravity when full or empty, maximum length, length, outer diameter, time to rocket motor ignition, thrust data for a thrust-time curve and change in altitude, circular error probability for guided projectiles, and reliability.

Figure 9:
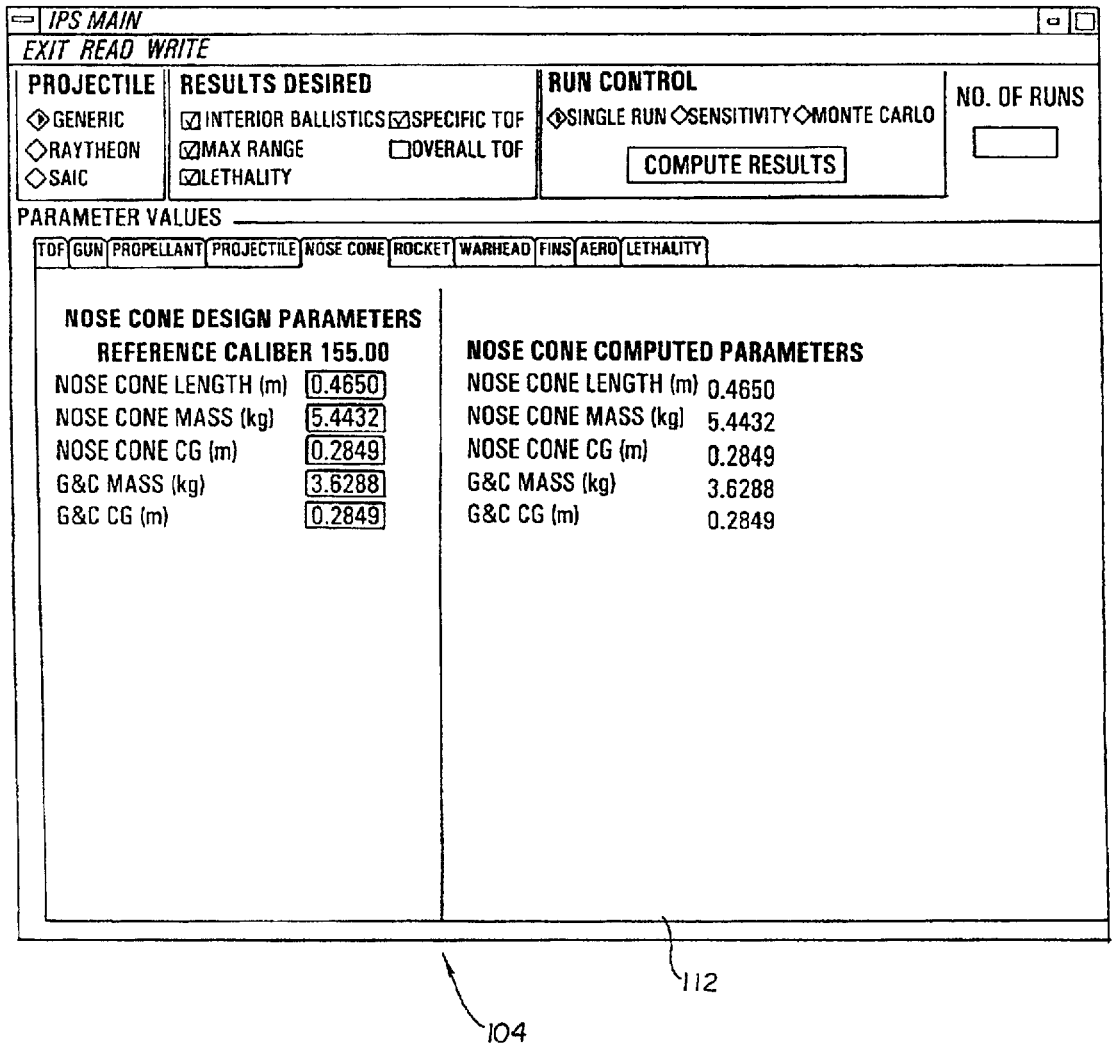
FIG. 9 is a panel or window display of nose cone design input parameters performance requirements, and nose cone computed parameters.

As shown in FIG. 9, design input parameters and performance requirements for a nose cone 112 of a determined caliber projectile include nose cone length, nose cone mass, nose cone center of gravity, guidance and control mass, and guidance and control center of gravity. Nose cone computed or performance or dependent parameters include nose cone length, nose cone mass, nose cone center of gravity, guidance and control mass, and guidance and control center of gravity. The causal network model and supporting database store tables, equations, and other information relating to nose cones, including mass; center of gravity; length; profile; volume; and material strength, density, and thickness.

Figure 10:
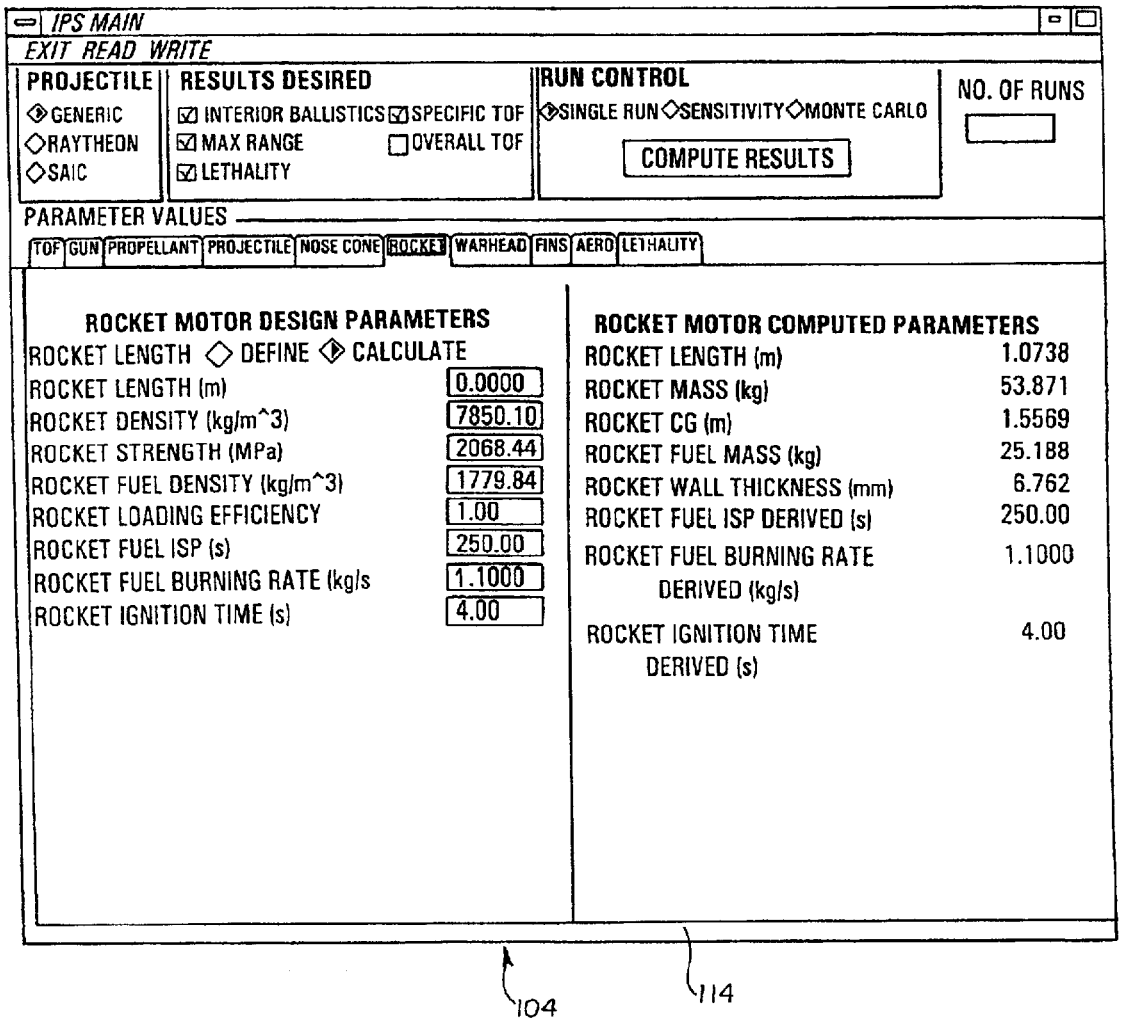
FIG. 10 is a panel or window display of rocket motor design input parameters performance requirements, and rocket motor computed parameters.

As shown in FIG. 10, design input parameters and performance requirements for rocket motors 114 include an option to define or calculate rocket length, rocket density, rocket wall strength, rocket fuel density, rocket loading efficiency, specific impulse of rocket fuel, rocket fuel burning rate, and rocket ignition time. Rocket motor computed or performance or dependent parameters include rocket length, rocket mass, rocket center of gravity, rocket fuel mass, rocket wall thickness, derived specific impulse of rocket fuel, and derived rocket ignition time. The causal network model and supporting database store tables, equations, and/or other information relating to rocket motors, including mass of the rocket motor when full and empty; center of gravity; length; volume; material strength, density, and wall thickness the rocket motor; specific impulse, density, loading efficiency, burning rate, and mass of fuel; thrust data for thrust-time curves and change in altitude; mass of insulation expended during burn; mass of other inert materials; and obturator position.

Figure 11:
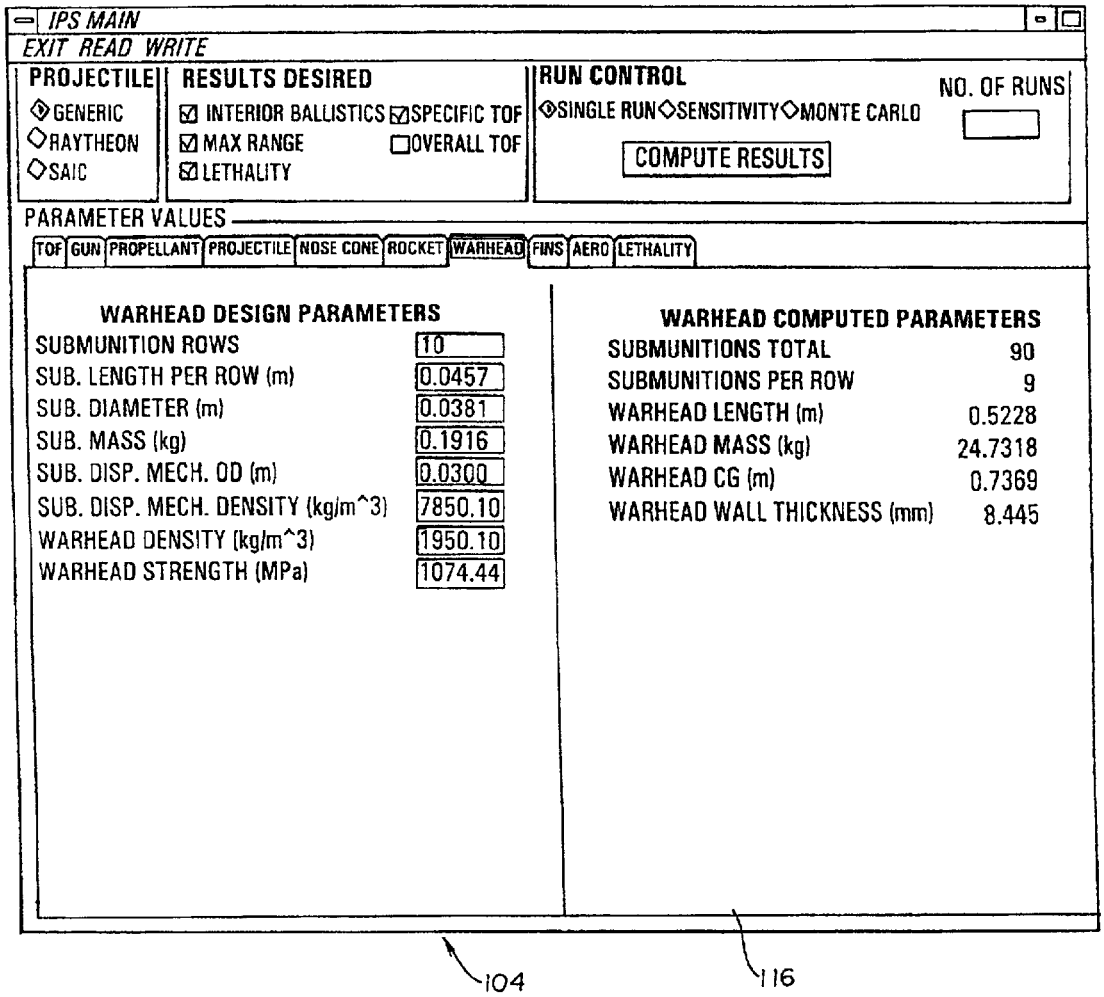
FIG. 11 is a panel or window display of warhead design input parameters performance requirements, and warhead computed parameters.

As shown in FIG. 11, design input parameters and performance requirements for warheads 116 include submunition rows, submunition length per row, submunition diameter, submunition mass, submunition dispersal mechanism outer diameter, submunition dispersal mechanism mech. Density, warhead density, and warhead strength. Warhead computed or performance or dependent parameters include total submunitions, submunitions per row, warhead length, warhead mass, warhead center of gravity, and warhead wall thickness. The causal network model and supporting database store tables, equations, and/or other information relating to warheads, including mass; center of gravity; length; material strength, density, and thickness; diameter, mass, length, number of rows, number per row, total number, dispersal radius, fall time, lethality D-zero value, and reliability of submunitions; mass of inert materials; location and/or size of inert materials; and location and/or size of dispense mechanism.

Figure 12:
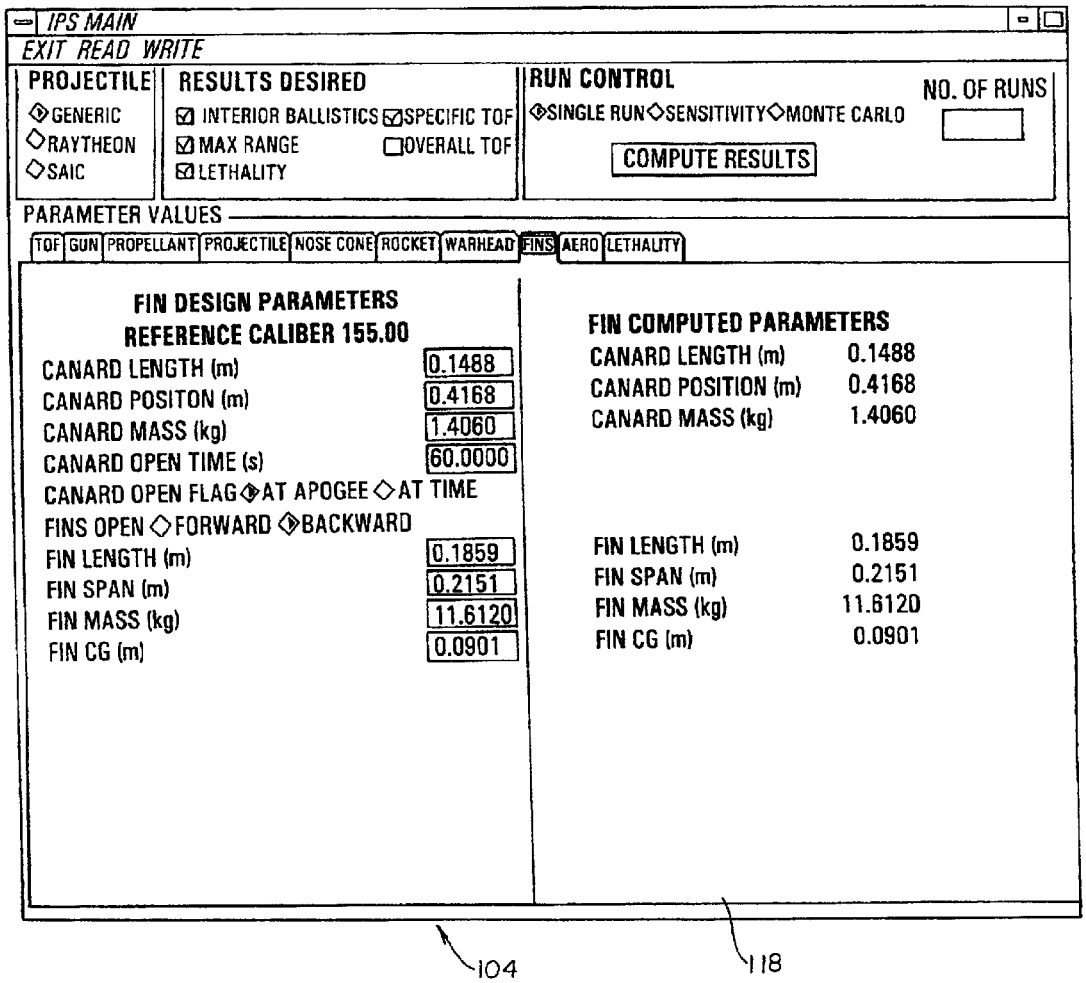
FIG. 12 is a panel or window display of fins and other control surfaces design input parameters performance requirements, and fins and other control surfaces computed parameters.

As shown in FIG. 12, design input parameters and performance requirements for fins or control surfaces 118 of a determined caliber projectile include canard length, canard position, canard mass, canard open time, options to set a canard open flag at apogee or when fins open and whether canards open forward or backwards, fin length, fin span, fin mass, and fin center of gravity. Fin computed or performance or dependent parameters include canard length, canard position, canard mass, fin length, fin span, fin mass, and fin center of gravity. The causal network model and supporting database store tables, equations, and/or other information relating to fins or control surfaces, including mass, center of gravity, length, span or semi-span, airfoil cross section, location of root, coord at semi-span locations, number, and forward or backwards opening style. The causal network model and database also store information for guidance, including mass, center of gravity, length, location, volume, guidance algorithm(s), and gains of a guidance package.

Figure 13:
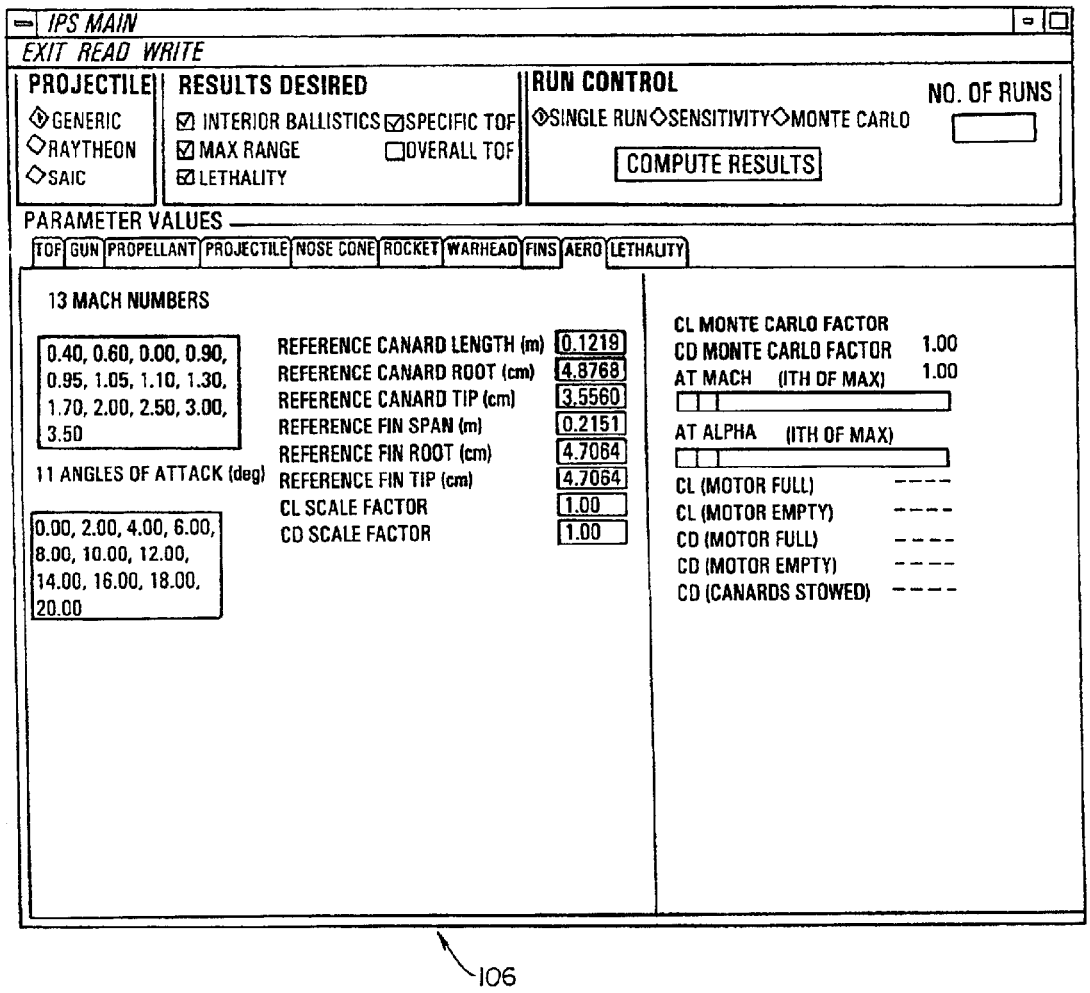
FIG. 13 is a panel or window display of aerodynamic design input parameters performance requirements, and aerodynamic computed parameters.

Aerodynamic data 106 for a projectile takes physical data for an exterior of a projectile and its control surfaces as well as the projectile's center of gravity and uses MissileDatCom to generate aerodynamic coefficients. Alternatively, the coefficients can be read from a file, such as are contractor supplied values. As shown in FIG. 13, aerodynamic design input parameters and performance requirements include mach and angle of attack to the wind numbers; reference canard length, reference canard root; reference canard tip, reference fin span, reference fin root, reference fin tip, lift coefficient scale factor, and drag coefficient scale factor. Aerodynamic computed or performance or dependent parameters include lift coefficient Monte Carlo factor; drag coefficient Monte Carlo factor; mach; angle of attack; lift coefficient when a rocket motor is full; lift coefficient when a rocket motor is empty; drag coefficient when a rocket motor is full; drag coefficient when a rocket motor is empty; and drag coefficient when canards are stowed.

The lethality data 108 is derived from a model that includes building up a target area from a description of a layout of the target area and characteristics of targets within the area. As shown in FIG. 14, lethality input parameters and performance requirements are subdivided into shot definition, target area definition, and target definition. Shot definition includes mission iterations, number of shots, firing rate, slop time, an option whether mission type is multiple round simulation impact (MRSI) or non-MRSI, whether sheaf is open or converged, submunitions dispersal radius, submunitions dispersal radius sigma, time of fall, time of fall sigma, mean point of impact (MPI) range error, MPI deflection error, precision range error, and precision deflection error. Target area definition can be set for the target range set for the minimum and maximum time of flight, target area length, target area width, target area orientation, observer position error, and observer orientation error. Target definitions include thirteen stored target definitions for defining lethal area, whether hardening is enabled or disabled, hardened lethal area, minimum time to harden, maximum time to harden, whether positioning is fixed or random, number of subtargets, whether targets can react or not, minimum time to react, maximum time to react, acceleration of target, velocity of target, whether target bearing is fixed or random, and the bearing of the target. Target definitions may be selected from the stored definitions or created by a user. The graphics window displaying these input parameters also allows a user to remove a particular target from a target scenario.

The user interface 20 allows a user to control all aspects of the system's behavior. The user interface has a level of user friendliness that is acceptable to engineers, analysts, and project managers. A user may selectively control the preferred embodiment either from a command line or through the graphical user interface 21. When the command line is used, a user uses a text editor to directly edit input files as needed. The user then types the appropriate command to run the causal network model 40. Control is returned to the user at the command prompt when the run is completed. A graphical user interface is developed using the Builder Xcessory (BX)™ toolkit, which generates motif GUI code in C++. When the graphical user interface 21 is used, this interface interacts with the causal network model 40 on behalf of the user. The user interface 20 is in a separate software class from the class holding the virtual simulation system 80, as this separation facilitates implementing the control system 60, especially when the control system 60 utilizes a commercially available optimizer. As with other parts of the integrated evaluation and simulation system, the graphical user interface 21 is designed to be highly modular and easily modifiable and expandable. Input and output often used within a single working session, as described above, have their own user interface panels, while input and output that is infrequently accessed, or accessed only after multiple working sessions, is accessible via data files or the database. The graphical user interface detailed design preferably takes the form of a series of panel designs that contain the detail on behavior, functionality, and parameters accessible by the respective panels.

The preferred embodiment has a virtual simulation system that includes models for system update, system performance, and system effectiveness analysis. The system performance models include models for interior ballistics, maximum range, specific minimum and maximum time of flight, and overall minimum and maximum time of flight. The interior ballistics results are generated by a barrel wear model, computing relative barrel wear using a Smith/Obrasky equation and input propellant temperature, propellant impetus, chamber pressure, and firing rate, and a muzzle velocity model, using input projectile mass, peak chamber pressure, barrel travel, chamber volume, and propellant information to generate a muzzle velocity. The muzzle velocity model is always run so that there will be a current muzzle velocity for other models. The maximum range models exercise a projectile flyout routine to find the minimum and maximum time of flight to the specified range at each quadrant elevation. A user specifies the range of quadrant elevations of interest and can specify either guided flight or assume flight only at maximum lift over drag (L/D). The specific minimum and maximum time of flight results are generated by exercising the projectile flyout routine to find the minimum and maximum time of flight to the specified range at each quadrant elevation. The overall minimum and maximum time of flight results are generated by exercising the projectile flyout routine to find the minimum and maximum time of flight at each target altitude and each range at each quadrant elevation. The system effectiveness analysis models include lethality models, which calculate fractional damage results generated by inputting the specific minimum and maximum time of flight table, either generated by the above method or making one specifically for a mission, into the lethality model. This model uses data from the lethality input parameters and a Carlton Damage equation to compute an estimated fractional damage value.

Figure 15:
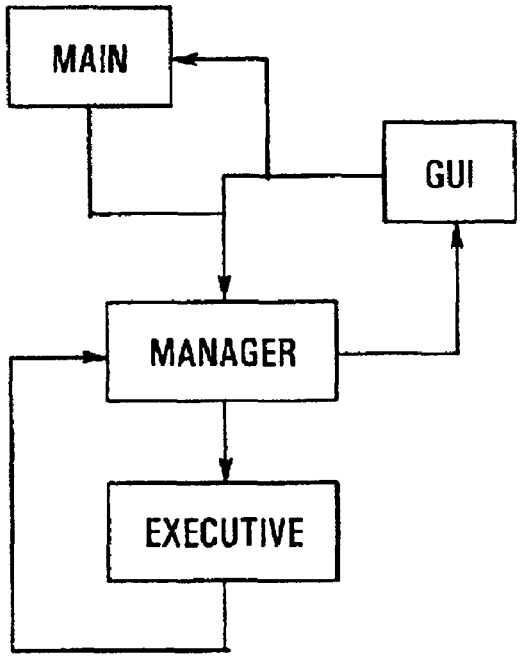
FIG. 15 is a depiction of the class holding the system management processes.
Figure 16:
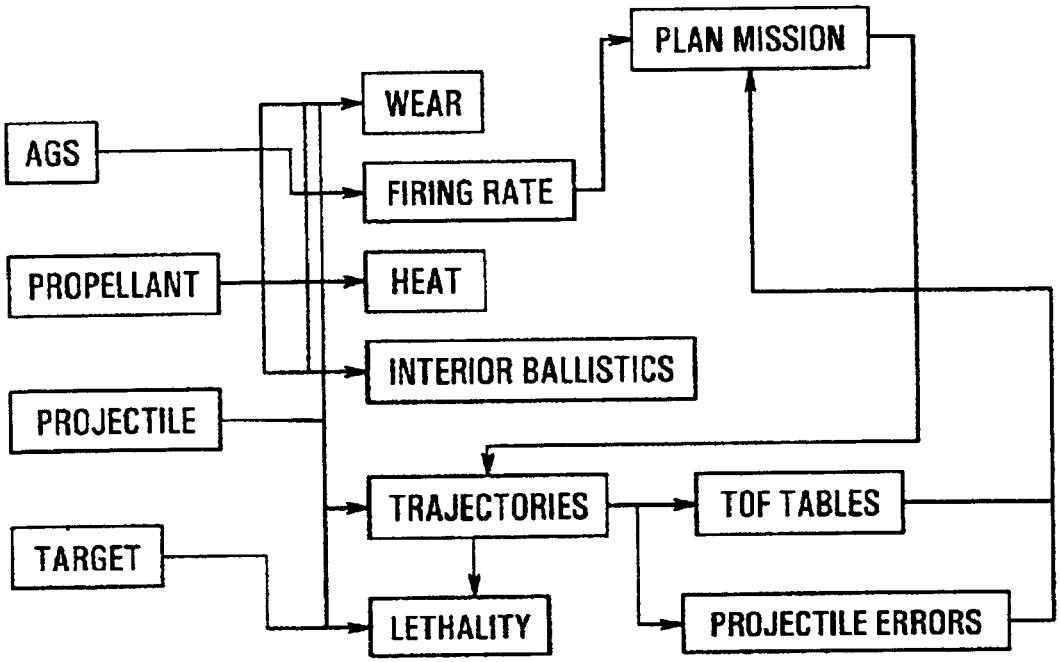
FIG. 16 is a depiction of the class holding the causal network model.

Preferably the integrated evaluation and simulation system 10 has no unique requirements of its operational environments, including hardware and software environments. The preferred embodiment of the present invention runs in a UNIX or LINUX operating environment and is accessible from any Sun or Silicon Graphics Incorporated (SGI) workstation; an SGI system is used to generate plots of analysis results. Those skilled in the art are aware that other present and future computing system platforms may be used to support the integrated evaluation and simulation system 10. The preferred embodiment is presently written in the object oriented language C++, and the computational engine accepts input from ASCII text input files and is capable of creating three-dimensional plots and numerical tables. The system utilizes two classes as shown in FIGS. 15 and 16, focusing respectively on system management processes 130 and the virtual simulation system 132. The class holding the system management processes includes a manager for data control and an executive for directing processes such as pulsing the causal network model and/or directing mode run routines.

Figure 17:
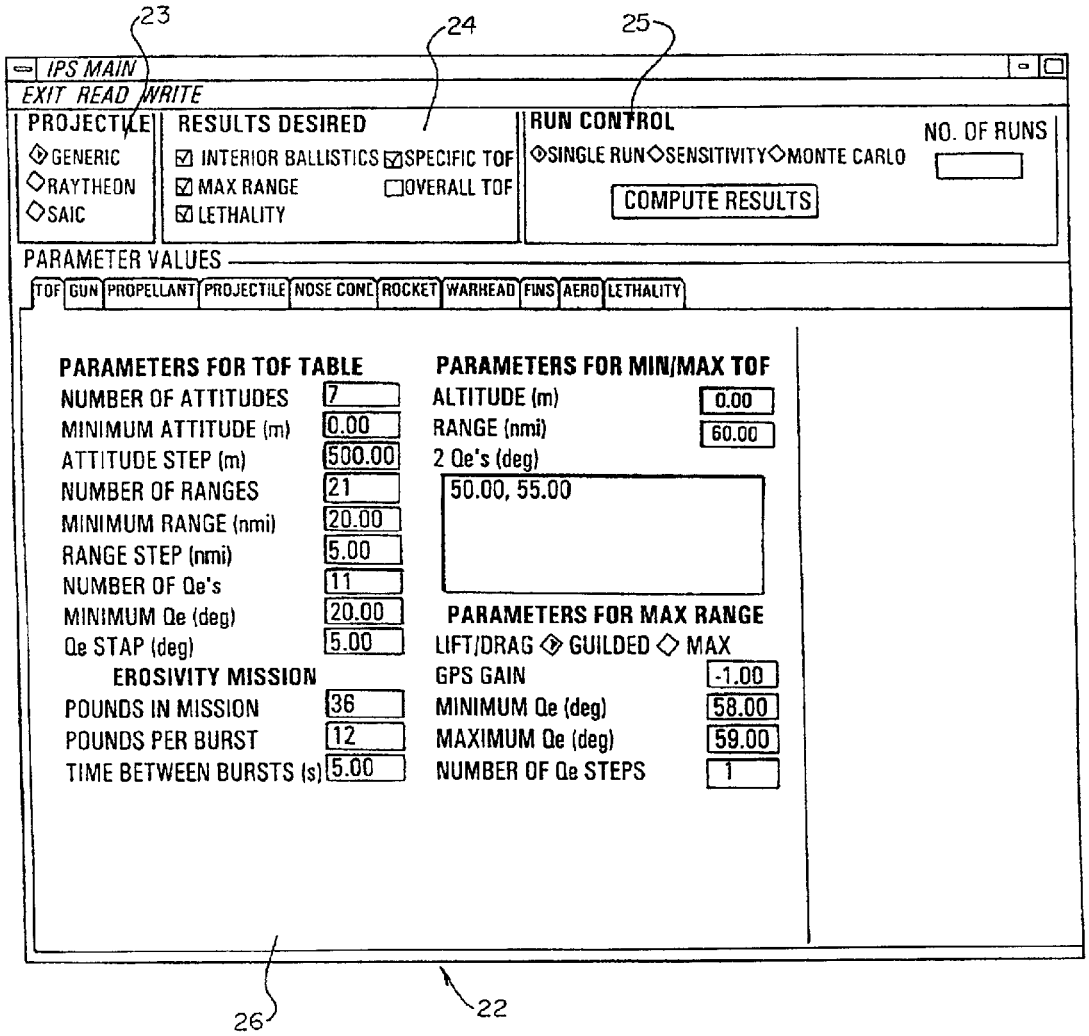
FIG. 17 is the initial panel or window display, showing time of flight, mission, and range input parameters.

The purpose of the computer system for advanced naval gun systems is to design optimal naval gun systems, as measured by the gun systems' combat effectiveness and given specified design input parameters, performance requirements, and resource constraints. When the integrated evaluation and simulation system is first called, as shown in FIG. 17-, the time of flight window or panel 22 appears first. This window functions at the system control level. The graphics of this window is divided into four regions, the projectile region, 23, the results desired region 24, the mode run control region 25, and the parameter values region 26. The projectile region includes check boxes for selecting the kind of projectile used during an analysis, which may be generic, for which parameters need to be determined by the system, or specific to a supplier, in which instance the supplier specifies the parameters. The mode run control region includes boxes for selecting the mode of analysis, for entering the number of runs desired for Monte Carlo runs, and a start or compute button to initiate processing of input data once all the data in entered in the appropriate windows or panels. The parameter values region includes a plurality of tabs for selecting parameters related to the nine areas described above in the causal network model and virtual simulation system as well as parameters for time of flight. Performance requirements input on the time of flight window include parameters for a time of flight table, erosivity mission, parameters for minimum and maximum time of flight, and parameters for maximum range. The parameters for a time of flight table include number of altitudes, minimum altitudes, altitude step, number of ranges, minimum range, range step, number of quadrant elevations, minimum quadrant elevation, and quadrant elevation step. The parameters for erosivity mission include rounds in mission, rounds per burst, and time between bursts. The parameters for minimum and maximum time of flight include altitude, range, and at least a minimum and a maximum quadrant elevation, and the parameters for maximum range include options for selecting guided and maximum lift and drag, minimum quadrant elevation, maximum quadrant elevation, and number of quadrant steps.

After the required input has been entered on the various tabs, and the compute results button has been clicked, the data is sent to the causal network by the control system where the specified mode is run using the input and information from the database. Design parameters are calculated first for the gun, propellant, and projectile. Next aerodynamic coefficients are calculated and then the time of flight of the projectile. This intermediate information is sent to the database for storage and to the virtual simulation system to calculate results using the system update, system performance, and system effectiveness models. This results information is then sent to the computational engine and to the database and can be viewed through the graphical user interface.

Computational speed is defined for each mode of operation in terms of execution on a currently available UNIX Silicon Graphics workstation. In the single-run mode, which involves propagating all inputs through the causal network model and into a virtual simulator, 2 minutes or less is required. In the dependencies mode, a run time of less than 10 seconds is required. In the sensitivities mode, a run time of 2 minutes or less is required for each increment of the independent variables. In the Monte Carlo mode, a run time of 2 minutes of less is required for each random variable selection. In the optimization mode, a run time of 1 hour or less for 6 independent variables is acceptable, and a run time of 2 days or less is acceptable for global optimization. These times are established for output having a computational error that does not exceed a predetermined percentile for any single computed variable, presently ten percent, when compared to actual test data.

Although preferred embodiments using data 100–108 have been described herein, those skilled in the art understand that some or all of the described preferred data may be used together, separately, or with additional kinds of data.

Although the preferred embodiment of the integrated evaluation and simulation system for advanced naval gun systems has been described herein, it should be recognized that numerous changes and variations can be made and that the scope of the present invention is to be defined by the claims.

What is claimed is:

1. An integrated evaluation and simulation system for an advanced naval gun system, comprising:

a computer system programmed to implement a computational engine having a causal network model factoring at least one interrelationship among a plurality of critical combat effectiveness functional attributes and constrained resources for the naval gun system, to create an optimally combat effective virtual representation of the naval gun system;

wherein the computational engine runs in a plurality of modes including a single run mode, a dependencies mode, a sensitivities mode, a Monte Carlo mode and an optimizing mode;

wherein the single run mode performs a single iteration through the causal network model to produce a set of intermediate and final results, the single run mode permitting one or more input variables of a set to be changed during operation to compute and display a point solution for the set of input parameters;

wherein the dependencies mode rapidly and visually identifies at least one interrelationship between design attributes and performance parameters within the causal network model by computing and displaying downstream performance parameters affected upon a change to a user-selected upstream input value;

wherein the sensitivities mode evaluates weapon system performance in terms of one or more design parameters in the causal network model by providing for the computational engine to perform multiple single-run passes through the causal network, each single-run pass attended by a variation of an input design parameter over a specified range so as to evaluate effects of the variation of the input design parameter on at least one performance parameter;

wherein the Monte Carlo mode assesses a probability of meeting specified requirements by inserting user-selected technological and manufacturing uncertainty into an analysis to create an optimally combat effective virtual representation of the naval gun system, the Monte Carlo mode providing for user-defined variation of selected parameters by specifying means and standard deviation sigmas of said selected parameters and causing a random draw to be performed on each of the selected parameters before executing a single run mode to collect statistics on the parameters and results from which a mean, standard deviation, minimum and maximum outcome for parameters derived from said selected parameters;

wherein the optimization mode determines best mix of design parameters that optimize a naval gun system's combat effectiveness while satisfying specified performance requirements and resource constraints selected from a user-defined set of design parameters, the optimization mode achieved by using special algorithms to pulse the causal network model until the design parameters converge to within predefined limits;

at least one virtual simulation system operatively connected to the computational engine for simulating the naval gun system; and a user interface operatively connected to at least the computer system for selectively inputting data into the computational engine and receiving information from the computational engine and the virtual simulation system.

2. The system of claim 1, wherein the combat effectiveness functional attributes include:

gun composition, propellant characteristics, projectile composition, projectile aerodynamic characteristics, and lethality;

the gun composition including at least one parameter related to a gun barrel selected from the set consisting of physical characteristics, assembly, and performance;

the propellant characteristics further including at least one parameter related to loading density, mass, maximum service pressure, impetus, flame temperature, covolume, density, specific heat ratios, grain diameter, length, perforation diameter, number of perforations, burning rate, and deterrent, temperature reduction, igniter mass, impetus, and flame temperature, and case mass;

the projectile composition further including at least one parameter selected from the set consisting of mass for both a full and empty projectile, center of gravity when full or empty, maximum length, length, outer diameter, time to rocket motor ignition, thrust data for a thrust-time curve and change in altitude, circular error probability for guided projectiles, and reliability;

the projectile aerodynamic characteristics including at least one parameter selected from the set consisting of mach and angle of attack to wind numbers, reference canard length, reference canard root, reference canard tip, reference fin span, reference fin root, reference fin tip, lift coefficient scale factor, drag coefficient scale factor, lift coefficient Monte Carlo factor, drag coefficient Monte Carlo factor, lift coefficient when a rocket motor is full, lift coefficient when a rocket motor is empty, drag coefficient when a rocket motor is full, drag coefficient when a rocket motor is empty, and drag coefficient when canards are stowed; and the lethality associated with lethality related data selected from the set consisting of mission iterations, number of shots, firing rate, slop time, multiple round simulation impact (MRSI) mission type, non-MRSI mission type, open sheaf, converged sheaf, submunitions dispersal radius, submunitions dispersal radius sigma, time of fall, time of fall sigma, mean point of impact (MPI) range error, MPI deflection error, precision range error, precision deflection error, minimum and maximum time of flight, target area length, target area width, target area orientation, observer position error, observer orientation error, whether hardening is enabled or disabled, hardened lethal area, minimum time to harden, maximum time to harden, whether positioning is fixed or random, number of subtargets, whether targets can react or not, minimum time to react, maximum time to react, acceleration of target, velocity of target, whether target bearing is fixed or random, and the bearing of the target; the constrained resources including a cost constraint on each of said resources.

3. The system of claim 1, wherein the system includes a database operatively connected to the computational engine and the virtual simulation system.

4. The system of claim 1, wherein the virtual simulation system includes models for system update, system performance, and system effectiveness analysis.

5. The system of claim 1, wherein the computational engine implements a modular software architecture down to a naval gun system component level, and wherein each module is represented by a separate subroutine.

6. The system of claim 1, wherein the user interface has a menu driven graphical user interface.

7. The system of claim 1, wherein the computational engine has a control system that is at least partially based on gradient search methodology.

8. An integrated evaluation system for an advanced naval gun system, comprising:

a computer system programmed to implement a computational engine factoring at least one interrelationship among a plurality of critical combat effectiveness functional attributes and constrained resources for the naval gun system, and to create a virtual representation of the naval gun system, the combat effectiveness functional attributes including gun composition, propellant characteristics, projectile composition, projectile aerodynamic characteristics, and lethality;

wherein the computational engine runs in a plurality of modes including a single run mode, a dependencies mode, a sensitivities mode, a Monte Carlo mode and an optimizing mode;

wherein the single run mode performs a single iteration through the causal network model to produce a set of intermediate and final results, the single run mode permitting one or more input variables of a set to be changed during operation to compute and display a point solution for the set of input parameters;

wherein the dependencies mode rapidly and visually identifies at least one interrelationship between design attributes and performance parameters within the causal network model by computing and displaying downstream performance parameters affected upon a change to a user-selected upstream input value;

wherein the sensitivities mode evaluates weapon system performance in terms of one or more design parameters in the causal network model by providing for the computational engine to perform multiple single-run passes through the causal network, each single-run pass attended by a variation of an input design parameter over a specified range so as to evaluate effects of the variation of the input design parameter on at least one performance parameter;

wherein the Monte Carlo mode assesses a probability of meeting specified requirements by inserting user-selected technological and manufacturing uncertainty into an analysis to create an optimally combat effective virtual representation of the naval gun system, the Monte Carlo mode providing for user-defined variation of selected parameters by specifying means and standard deviation sigmas of said selected parameters and causing a random draw to be performed on each of the selected parameters before executing a single run mode to collect statistics on the parameters and results from which a mean, standard deviation, minimum and maximum outcome for parameters derived from said selected parameters;

wherein the optimization mode determines a best mix of design parameters that optimize a naval gun system's combat effectiveness while satisfying specified performance requirements and resource constraints and selected from a user-defined set of design parameters, the optimization mode achieved by using special algorithms to pulse the causal network model until the design parameters converge to within predefined limits; and a user interface operatively connected to the computer system to selectively input data into and receive information from the computational engine.

9. The system of claim 8, wherein the gun composition includes at least one parameter related to a gun barrel selected from the set consisting of physical characteristics, assembly, and performance;

the propellant characteristics further including at least one parameter related to loading density, mass, maximum service pressure, impetus, flame temperature, covolume, density, specific heat ratios, grain diameter, length, perforation diameter, number of perforations, burning rate, and deterrent, temperature reduction, igniter mass, impetus, and flame temperature, and case mass;

the projectile composition further including at least one parameter selected from the set consisting of mass for both a full and empty projectile, center of gravity when full or empty, maximum length, length, outer diameter, time to rocket motor ignition, thrust data for a thrust-time curve and change in altitude, circular error probability for guided projectiles, and reliability;

the projectile aerodynamic characteristics including at least one parameter selected from the set consisting of mach and angle of attack to wind numbers; reference canard length, reference canard root, reference canard tip, reference fin span, reference fin root, reference fin tip, lift coefficient scale factor, drag coefficient scale factor, lift coefficient Monte Carlo factor, drag coefficient Monte Carlo factor, lift coefficient when a rocket motor is full, lift coefficient when a rocket motor is empty, drag coefficient when a rocket motor is full, drag coefficient when a rocket motor is empty, and drag coefficient when canards are stowed;

the lethality associated with lethality related data selected from the set consisting of mission iterations, number of shots, firing rate, slop time, multiple round simulation impact (MRSI) mission type, non-MRSI mission type, open sheaf, converged sheaf, submunitions dispersal radius, submunitions dispersal radius sigma, time of fall, time of fall sigma, mean point of impact (MPI) range error, MPI deflection error, precision range error, precision deflection error, minimum and maximum time of flight, target area length, target area width, target area orientation, observer position error, observer orientation error, whether hardening is enabled or disabled, hardened lethal area, minimum time to harden, maximum time to harden, whether positioning is fixed or random, number of subtargets, whether targets can react or not, minimum time to react, maximum time to react, acceleration of target, velocity of target, whether target bearing is fixed or random, and the bearing of the target; and the constrained resources including a cost constraint on each of said resources.

10. A computer system programmed to implement a computational engine for optimizing combat effectiveness of an advanced naval gun system by determining an optimal set of design parameters for the naval gun system that satisfy a plurality of critical combat effectiveness functional attributes and constrained resources for the naval gun system, comprising:

a causal network model factoring at least one interrelationship among the critical combat effectiveness functional attributes and constrained resources, the combat effectiveness functional attributes including gun composition, propellant characteristics, projectile composition, projectile aerodynamic characteristics, and lethality;

wherein the computational engine runs in a plurality of modes including a single run mode, a dependencies mode, a sensitivities mode, a Monte Carlo mode and an optimizing mode;

the single run mode performs a single iteration through the causal network model to produce a set of intermediate and final results, the single run mode permitting one or more input variables of a set to be changed during operation to compute and display a point solution for the set of input parameters;

wherein the dependencies mode rapidly and visually identify at least one interrelationship between design attributes and performance parameters within the causal network model by computing and displaying downstream performance parameters affected upon a change to a user-selected upstream input value;

the sensitivities mode evaluates weapon system performance in terms of one or more design parameters in the causal network model by providing for the computational engine to perform multiple single-run passes through the causal network, each single-run pass attended by a variation of an input design parameter over a specified range so as to evaluate effects of the variation of the input design parameter on at least one performance parameter;

wherein the Monte Carlo mode assesses a probability of meeting specified requirements by inserting user-selected technological and manufacturing uncertainty into an analysis to create an optimally combat effective virtual representation of the naval gun system, the Monte Carlo mode providing for user-defined variation of selected parameters by specifying means and standard deviation sigmas of said selected parameters and causing a random draw to be performed on each of the selected parameters before executing a single run mode to collect statistics on the parameters and results from which a mean, standard deviation, minimum and maximum outcome for parameters derived from said selected parameters;

wherein the optimization mode determines a best mix of design parameters that optimize a naval gun system's combat effectiveness while satisfying specified performance requirements and resource constraints and selected from a user-defined set of design parameters, the optimization mode achieved by using special algorithms to pulse the causal network model until the design parameters converge to within a predetermined error percentile; and a control system at least partly based on gradient search methodology, wherein the control system pulses the causal network model until each of the design parameters converges to within the predetermined error percentile.

11. The system of claim 10, wherein the predetermined error is ten percent for any single computed design parameter.

12. The system of claim 10, wherein the gun composition includes at least one parameter related to a gun barrel selected from the set consisting of physical characteristics, assembly, and performance;

the propellant characteristics further including at least one parameter related to loading density, mass, maximum service pressure, impetus, flame temperature, covolume, density, specific heat ratios, grain diameter, length, perforation diameter, number of perforations, burning rate, and deterrent, temperature reduction, igniter mass, impetus, and flame temperature, and case mass;

the projectile composition further including at least one parameter selected from the set consisting of mass for both a full and empty projectile, center of gravity when full or empty, maximum length, length, outer diameter, time to rocket motor ignition, thrust data for a thrust-time curve and change in altitude, circular error probability for guided projectiles, and reliability;

the projectile aerodynamic characteristics including at least one parameter selected from the set consisting of mach and angle of attack to wind numbers; reference canard length, reference canard root, reference canard tip, reference fin span, reference fin root, reference fin tip, lift coefficient scale factor, drag coefficient scale factor, lift coefficient Monte Carlo factor, drag coefficient Monte Carlo factor, lift coefficient when a rocket motor is full, lift coefficient when a rocket motor is empty, drag coefficient when a rocket motor is full, drag coefficient when a rocket motor is empty, and drag coefficient when canards are stowed;

the lethality associated with lethality related data selected from the set consisting of mission iterations, number of shots, firing rate, slop time, multiple round simulation impact (MRSI) mission type, non-MRSI mission type, open sheaf, converged sheaf, submunitions dispersal radius, submunitions dispersal radius sigma, time of fall, time of fall sigma, mean point of impact (MPI) range error, MPI deflection error, precision range error, precision deflection error, minimum and maximum time of flight, target area length, target area width, target area orientation, observer position error, observer orientation error, whether hardening is enabled or disabled, hardened lethal area, minimum time to harden, maximum time to harden, whether positioning is fixed or random, number of subtargets, whether targets can react or not, minimum time to react, maximum time to react, acceleration of target, velocity of target, whether target bearing is fixed or random, and the bearing of the target; and the constrained resources including a cost constraint on each of said resources.

13. An integrated evaluation and simulation system for an advanced naval gun system, comprising:

computational means having a causal network model factoring at least one interrelationship among a plurality of critical combat effectiveness functional attributes and constrained resources for the naval gun system to create a virtual representation of the naval gun system, the combat effectiveness functional attributes including gun composition, propellant characteristics, projectile composition, projectile aerodynamic characteristics, and lethality;

a computational engine that runs in a plurality of modes including a single run mode, a dependencies mode, a sensitivities mode, a Monte Carlo mode and an optimizing mode;

wherein the single run mode performs a single iteration through the causal network model to produce a set of intermediate and final results, the single run mode permitting one or more input variables of a set to be changed during operation to compute and display a point solution for the set of input parameters;

wherein the dependencies mode rapidly and visually identifies at least one interrelationship between design attributes and performance parameters within the causal network model by computing and displaying downstream performance parameters affected upon a change to a user-selected upstream input value;

wherein the sensitivities mode evaluates weapon system performance in terms of one or more design parameters in the causal network model by providing for the computational engine to perform multiple single-run passes through the causal network, each single-run pass attended by a variation of an input design parameter over a specified range so as to evaluate effects of the variation of the input design parameter on at least one performance parameter;

wherein the Monte Carlo mode assesses a probability of meeting specified requirements by inserting user-selected technological and manufacturing uncertainty into an analysis to create an optimally combat effective virtual representation of the naval gun system, the Monte Carlo mode providing for user-defined variation of selected parameters by specifying means and standard deviation sigmas of said selected parameters and causing a random draw to be performed on each of the selected parameters before executing a single run mode to collect statistics on the parameters and results from which a mean, standard deviation, minimum and maximum outcome for parameters derived from said selected parameters;

wherein the optimization mode determines a best mix of design parameters that optimize a naval gun system's combat effectiveness while satisfying specified performance requirements and resource constraints and selected from a user-defined set of design parameters, the optimization mode achieved by using special algorithms to pulse the causal network model until the design parameters converge to within predefined limits;

simulation means for simulating a virtual representation of the naval gun system, wherein the simulation means is operatively connected to the computational means; and interface means for selectively inputting data into the computational means and receiving information from the computational means and the simulation means.

14. The system of claim 13, wherein the gun composition includes at least one parameter related to a gun barrel selected from the set consisting of physical characteristics, assembly, and performance;

the propellant characteristics further including at least one parameter related to loading density, mass, maximum service pressure, impetus, flame temperature, covolume, density, specific heat ratios, grain diameter, length, perforation diameter, number of perforations, burning rate, and deterrent, temperature reduction, igniter mass, impetus, and flame temperature, and case mass;

the projectile composition further including at least one parameter selected from the set consisting of mass for both a full and empty projectile, center of gravity when full or empty, maximum length, length, outer diameter, time to rocket motor ignition, thrust data for a thrust-time curve and change in altitude, circular error probability for guided projectiles, and reliability;

the projectile aerodynamic characteristics including at least one parameter selected from the set consisting of mach and angle of attack to wind numbers, reference canard length, reference canard root, reference canard tip, reference fin span, reference fin root, reference fin tip, lift coefficient scale factor, drag coefficient scale factor, lift coefficient Monte Carlo factor, drag coefficient Monte Carlo factor, lift coefficient when a rocket motor is full, lift coefficient when a rocket motor is empty, drag coefficient when a rocket motor is full, drag coefficient when a rocket motor is empty, and drag coefficient when canards are stowed;

the lethality associated with lethality related data selected from the set consisting of mission iterations, number of shots, firing rate, slop time, multiple round simulation impact (MRSI) mission type, non-MRSI mission type, open sheaf, converged sheaf, submunitions dispersal radius, submunitions dispersal radius sigma, time of fall, time of fall sigma, mean point of impact (MPI) range error, MPI deflection error, precision range error, precision deflection error, minimum and maximum time of flight, target area length, target area width, target area orientation, observer position error, observer orientation error, whether hardening is enabled or disabled, hardened lethal area, minimum time to harden, maximum time to harden, whether positioning is fixed or random, number of subtargets, whether targets can react or not, minimum time to react, maximum time to react, acceleration of target, velocity of target, whether target bearing is fixed or random, and the bearing of the target; and the constrained resources including a cost constraint on each of said resources.

15. An integrated evaluation and simulation system for an advanced naval gun system, comprising:

a computer system programmed to implement a computational engine factoring at least one interrelationship among a plurality of critical combat effectiveness functional attributes and constrained resources for the naval gun system, to create an optimally combat effective virtual representation of the naval gun system, wherein the computational engine has a modular software architecture down to a naval gun system component level, the modular software architecture having a plurality of modules with each module represented by a separate subroutine, the combat effectiveness functional attributes including gun composition, propellant characteristics, projectile composition, projectile aerodynamic characteristics, and lethality;

wherein the computational engine runs in a plurality of modes including a single run mode, a dependencies mode, a sensitivities mode, a Monte Carlo mode and an optimizing mode;

wherein the single run mode performs a single iteration through the causal network model to produce a set of intermediate and final results, the single run mode permitting one or more input variables of a set to be changed during operation to compute and display a point solution for the set of input parameters;

wherein the dependencies mode rapidly and visually identifies at least one interrelationship between design attributes and performance parameters within the causal network model by computing and displaying downstream performance parameters affected upon a change to a user-selected upstream input value;

wherein the sensitivities mode evaluates weapon system performance in terms of one or more design parameters in the causal network model by providing for the computational engine to perform multiple single-run passes through the causal network, each single-run pass attended by a variation of an input design parameter over a specified range so as to evaluate effects of the variation of the input design parameter on at least one performance parameter;

wherein the Monte Carlo mode assesses a probability of meeting specified requirements by inserting user-selected technological and manufacturing uncertainty into an analysis to create an optimally combat effective virtual representation of the naval gun system, the Monte Carlo mode providing for user-defined variation of selected parameters by specifying means and standard deviation sigmas of said selected parameters and causing a random draw to be performed on each of the selected parameters before executing a single run mode to collect statistics on the parameters and results from which a mean, standard deviation, minimum and maximum outcome for parameters derived from said selected parameters;

wherein the optimization mode determines a best mix of design parameters that optimize a naval gun system's combat effectiveness while satisfying specified performance requirements and resource constraints and selected from a user-defined set of design parameters, the optimization mode achieved by using special algorithms to pulse the causal network model until the design parameters converge to within predefined limits;

at least one virtual simulation system operatively connected to the computational engine for simulating the naval gun system; and a user interface operatively connected to at least the computer system for selectively inputting data into the computational engine and receiving information from the computational engine and the virtual simulation system.

16. The system of claim 15, wherein the gun composition includes at least one parameter related to a gun barrel selected from the set consisting of physical characteristics, assembly, and performance;

the propellant characteristics further including at least one parameter related to loading density, mass, maximum service pressure, impetus, flame temperature, covolume, density, specific heat ratios, grain diameter, length, perforation diameter, number of perforations, burning rate, and deterrent, temperature reduction, igniter mass, impetus, and flame temperature, and case mass;

the projectile composition further including at least one parameter selected from the set consisting of mass for both a full and empty projectile, center of gravity when full or empty, maximum length, length, outer diameter, time to rocket motor ignition, thrust data for a thrust-time curve and change in altitude, circular error probability for guided projectiles, and reliability;

the projectile aerodynamic characteristics including at least one parameter selected from the set consisting of mach and angle of attack to wind numbers, reference canard length, reference canard root, reference canard tip, reference fin span, reference fin root, reference fin tip, lift coefficient scale factor, drag coefficient scale factor, lift coefficient Monte Carlo factor, drag coefficient Monte Carlo factor, lift coefficient when a rocket motor is full, lift coefficient when a rocket motor is empty, drag coefficient when a rocket motor is full, drag coefficient when a rocket motor is empty, and drag coefficient when canards are stowed;

the lethality associated with lethality related data selected from the set consisting of mission iterations, number of shots, firing rate, slop time, multiple round simulation impact (MRSI) mission type, non-MRSI mission type, open sheaf, converged sheaf, submunitions dispersal radius, submunitions dispersal radius sigma, time of fall, time of fall sigma, mean point of impact (MPI) range error, MPI deflection error, precision range error, precision deflection error, minimum and maximum time of flight, target area length, target area width, target area orientation, observer position error, observer orientation error, whether hardening is enabled or disabled, hardened lethal area, minimum time to harden, maximum time to harden, whether positioning is fixed or random, number of subtargets, whether targets can react or not, minimum time to react, maximum time to react, acceleration of target, velocity of target, whether target bearing is fixed or random, and the bearing of the target; and the constrained resources including a cost constraint on each of said resources.

17. An integrated evaluation and simulation system for an advanced naval gun system, comprising:

a computer system programmed to implement a computational engine factoring at least one interrelationship among a plurality of critical combat effectiveness functional attributes and constrained resources for the naval gun system, to create an optimally combat effective virtual representation of the naval gun system, the combat effectiveness functional attributes including gun composition, propellant characteristics, projectile composition, projectile aerodynamic characteristics, and lethality;

wherein the computational engine runs in a plurality of modes including a single run mode, a dependencies mode, a sensitivities mode, a Monte Carlo mode and an optimizing mode;

wherein the single run mode performs a single iteration through the causal network model to produce a set of intermediate and final results, the single run mode permitting one or more input variables of a set to be changed during operation to compute and display a point solution for the set of input parameters;

wherein the dependencies mode rapidly and visually identifies at least one interrelationship between design attributes and performance parameters within the causal network model by computing and displaying downstream performance parameters affected upon a change to a user-elected upstream input value;

wherein the sensitivities mode evaluates weapon system performance in terms of one or more design parameters in the causal network model by providing for the computational engine to perform multiple single-run passes through the causal network, each single-run pass attended by a variation of an input design parameter over a specified range so as to evaluate effects of the variation of the input design parameter on at least one performance parameter;

wherein the Monte Carlo mode assesses a probability of meeting specified requirements by inserting user-selected technological and manufacturing uncertainty into an analysis to create an optimally combat-effective virtual representation of the naval gun system, the Monte Carlo mode providing for user-defined variation of selected parameters by specifying means and standard deviation sigmas of said selected parameters and causing a random draw to be performed on each of the selected parameters before executing a single run mode to collect statistics on the parameters and results from which a mean, standard deviation, minimum and maximum outcome for parameters derived from said selected parameters;

wherein the optimization mode determines a best mix of design parameters that optimize a naval gun system's combat effectiveness while satisfying specified performance requirements and resource constraints and selected from a user-defined set of design parameters, the optimization mode achieved by using special algorithms to pulse the causal network model until the design parameters converge to within predefined limits; and wherein the computational engine has a control system that is at least partially based on gradient search methodology;

at least one virtual simulation system operatively connected to the computational engine for simulating the naval gun system; and a user interface operatively connected to at least the computer system for selectively inputting data into the computational engine and receiving information from the computational engine and the virtual simulation system.

18. The system of claim 17, wherein the gun composition including at least one parameter related to a gun barrel selected from the set consisting of physical characteristics, assembly, and performance;

the propellant characteristics further including at least one parameter related to loading density, mass, maximum service pressure, impetus, flame temperature, covolume, density, specific heat ratios, grain diameter, length, perforation diameter, number of perforations, burning rate, and deterrent, temperature reduction, igniter mass, impetus, and flame temperature, and case mass; the projectile composition further including at least one parameter selected from the set consisting of mass for both a full and empty projectile, center of gravity when full or empty, maximum length, length, outer diameter, time to rocket motor ignition, thrust data for a thrust-time curve and change in altitude, circular error probability for guided projectiles, and reliability;

the projectile aerodynamic characteristics including at least one parameter selected from the set consisting of mach and angle of attack to wind numbers, reference canard length, reference canard root, reference canard tip, reference fin span, reference fin root, reference fin tip, lift coefficient scale factor, drag coefficient scale factor, lift coefficient Monte Carlo factor, drag coefficient Monte Carlo factor, lift coefficient when a rocket motor is full, lift coefficient when a rocket motor is empty, drag coefficient when a rocket motor is full, drag coefficient when a rocket motor is empty, and drag coefficient when canards are stowed;

the lethality associated with lethality related data selected from the set consisting of mission iterations, number of shots, firing rate, slop time, multiple round simulation impact (MRSI) mission type, non-MRSI mission type, open sheaf, converged sheaf, submunitions dispersal radius, submunitions dispersal radius sigma, time of fall, time of fall sigma, mean point of impact (MPI) range error, MPI deflection error, precision range error, precision deflection error, minimum and maximum time of flight, target area length, target area width, target area orientation, observer position error, observer orientation error, whether hardening is enabled or disabled, hardened lethal area, minimum time to harden, maximum time to harden, whether positioning is fixed or random, number of subtargets, whether targets can react or not, minimum time to react, maximum time to react, acceleration of target, velocity of target, whether target bearing is fixed or random, and the bearing of the target; and the constrained resources including a cost constraint on each of said resources.

19. An integrated evaluation and simulation system for an advanced naval gun system, comprising:

a computer system programmed to implement a computational engine factoring at least one interrelationship among a plurality of critical combat effectiveness functional attributes and constrained resources for the naval gun system, to create an optimally combat effective virtual representation of the naval gun system, the combat effectiveness functional attributes including gun composition, propellant characteristics, projectile composition, projectile aerodynamic characteristics, and lethality;

wherein the computational engine runs in a plurality of modes including a single run mode, a dependencies mode, a sensitivities mode, a Monte Carlo mode and an optimizing mode;

wherein the single run mode perform a single iteration through the causal network model to produce a set of intermediate and final results, the single run mode permitting one or more input variables of a set to be changed during operation to compute and display a point solution for the set of input parameters;

wherein the dependencies mode rapidly and visually identifies at least one interrelationship between design attributes and performance parameters within the causal network model by computing and displaying downstream performance parameters affected upon a change to a user-selected upstream input value;

wherein the sensitivities mode evaluates weapon system performance in terms of one or more design parameters in the causal network model by providing for the computational engine to perform multiple single-run passes through the causal network, each single-run pass attended by a variation of an input design parameter over a specified range so as to evaluate effects of the variation of the input design parameter on at least one performance parameter;

wherein the Monte Carlo mode assesses a probability of meeting specified requirements by inserting user-selected technological and manufacturing uncertainty into an analysis to create an optimally combat effective virtual representation of the naval gun system, the Monte Carlo mode providing for user-defined variation of selected parameters by specifying means and standard deviation sigmas of said selected parameters and causing a random draw to be performed on each of the selected parameters before executing a single run mode to collect statistics on the parameters and results from which a mean, standard deviation, minimum and maximum outcome for parameters derived from said selected parameters;

wherein the optimization mode determines a best mix of design parameters that optimize a naval gun system's combat effectiveness while satisfying specified performance requirements and resource constraints and selected from a user-defined set of design parameters, the optimization mode achieved by using special algorithms to pulse the causal network model until the design parameters converge to within predefined limits; and wherein a degree of optimization of a virtual representation of the naval gun system is selectively controllable;

at least one virtual simulation system operatively connected to the computational engine for simulating the naval gun system; and a user interface operatively connected to at least the computer system for selectively inputting data into the computational engine and receiving information from the computational engine and the virtual simulation system.

20. The system of claim 19, wherein the gun composition includes at least one parameter related to a gun barrel selected from the set consisting of physical characteristics, assembly, and performance;

the propellant characteristics further including at least one parameter related to loading density, mass, maximum service pressure, impetus, flame temperature, covolume, density, specific heat ratios, grain diameter, length, perforation diameter, number of perforations, burning rate, and deterrent, temperature reduction, igniter mass, impetus, and flame temperature, and case mass;

the projectile composition further including at least one parameter selected from the set consisting of mass for both a full and empty projectile, center of gravity when full or empty, maximum length, length, outer diameter, time to rocket motor ignition, thrust data for a thrust-time curve and change in altitude, circular error probability for guided projectiles, and reliability;

the projectile aerodynamic characteristics including at least one parameter selected from the set consisting of mach and angle of attack to wind numbers, reference canard length, reference canard root, reference canard tip, reference fin span, reference fin root, reference fin tip, lift coefficient scale factor, drag coefficient scale factor, lift coefficient Monte Carlo factor, drag coefficient Monte Carlo factor, lift coefficient when a rocket motor is full, lift coefficient when a rocket motor is empty, drag coefficient when a rocket motor is full, drag coefficient when a rocket motor is empty, and drag coefficient when canards are stowed;

the lethality associated with lethality related data selected from the set consisting of mission iterations, number of shots, firing rate, slop time, multiple round simulation impact (MRSI) mission type, non-MRSI mission type, open sheaf, converged sheaf, submunitions dispersal radius, submunitions dispersal radius sigma, time of fall, time of fall sigma, mean point of impact (MPI) range error, MPI deflection error, precision range error, precision deflection error, minimum and maximum time of flight, target area length, target area width, target area orientation, observer position error, observer orientation error, whether hardening is enabled or disabled, hardened lethal area, minimum time to harden, maximum time to harden, whether positioning is fixed or random, number of subtargets, whether targets can react or not, minimum time to react, maximum time to react, acceleration of target, velocity of target, whether target bearing is fixed or random, and the bearing of the target; and the constrained resources including a cost constraint on each of said resources.

21. A method of integrated evaluation and simulation for allocating resources across a system architecture of an advanced naval gun system to optimize combat effectiveness of the naval gun system, comprising:

a) providing a computer system having a user interface and a computational engine factoring at least one interrelationship among a plurality of critical combat effectiveness functional attributes and constrained resources for the naval gun system;

b) providing at least one virtual simulation system;

c) selectively inputting data into the computational engine to create a virtual representation of an optimally combat effective naval gun system in relation to at least one of the plurality of critical combat effectiveness functional attributes, the combat effectiveness functional attributes including gun composition, propellant characteristics, projectile composition, projectile aerodynamic characteristics, and lethality;

d) selecting a run mode for the computational engine from a group of run modes comprising a single run mode, a dependencies mode, a sensitivities mode, a Monte Carlo mode, and an optimizing mode, wherein the single run mode performs a single iteration through the causal network model to produce a set of intermediate and final results, the single run mode permitting one or more input variables of a set to be changed during operation to compute and display a point solution for the set of input parameters;

wherein the dependencies mode rapidly and visually identifies at least one interrelationship between design attributes and performance parameters within the causal network model by computing and displaying downstream performance parameters affected upon a change to a user-selected upstream input value;

wherein the sensitivities mode evaluates weapon system performance in terms of one or more design parameters in the causal network model by providing for the computational engine to perform multiple single-run passes through the causal network, each single-run pass attended by a variation of an input design parameter over a specified range so as to evaluate effects of the variation of the input design parameter on at least one performance parameter;

wherein the Monte Carlo mode assesses a probability of meeting specified requirements by inserting user-selected technological and manufacturing uncertainty into an analysis to create an optimally combat effective virtual representation of the naval gun system, the Monte Carlo mode providing for user-defined variation of selected parameters by specifying means and standard deviation sigmas of said selected parameters and causing a random draw to be performed on each of the selected parameters before executing a single run mode to collect statistics on the parameters and results from which a mean, standard deviation, minimum and maximum outcome for parameters derived from said selected parameters;

the optimization mode determines a best mix of design parameters that optimize a naval gun system's combat effectiveness while satisfying specified performance requirements and resource constraints and selected from a user-defined set of design parameters, the optimization mode achieved by using special algorithms to pulse the causal network model until the design parameters converge to within predefined limits;

e) selectively running the virtual representation of the optimally combat effective naval gun system in the at least one virtual simulation system; and f) utilizing information obtained from steps (d) and (e) to further enhance the virtual representation of the naval gun system.

22. In a computer system, a computer-readable storage media storing at least one computer program that operates as an integrated evaluator and simulator for allocating resources across a system architecture of an advanced naval gun system to optimize combat effectiveness of the naval gun system, the program comprising the steps of:

a) storing in the computer system a computational engine factoring at least one interrelationship among a plurality of critical combat effectiveness functional attributes and constrained resources for the naval gun system, the combat effectiveness functional attributes including gun composition, propellant characteristics, projectile composition, projectile aerodynamic characteristics, and lethality;

b) obtaining data necessary for the program to create a virtual representation;

c) running the computational engine in a run mode selected from a group of run modes comprising a single run mode, a dependencies mode, a sensitivities mode, a Monte Carlo mode, and an optimizing mode to create the virtual representation of the naval gun system, wherein the single run mode performs a single iteration through the causal network model to produce a set of intermediate and final results, the single run mode permitting one or more input variables of a set to be changed during operation to compute and display a point solution for the set of input parameters;

wherein the dependencies mode rapidly and visually identifies at least one interrelationship between design attributes and performance parameters within the causal network model by computing and displaying downstream performance parameters affected upon a change to a user-selected upstream input value;

wherein the sensitivities mode evaluates weapon system performance in terms of one or more design parameters in the causal network model by providing for the computational engine to perform multiple single-run passes through the causal network, each single-run pass attended by a variation of an input design parameter over a specified range so as to evaluate effects of the variation of the input design parameter on at least one performance parameter;

wherein the Monte Carlo mode assesses a probability of meeting specified requirements by inserting user-selected technological and manufacturing uncertainty into an analysis to create an optimally combat effective virtual representation of the naval gun system, the Monte Carlo mode providing for user-defined variation of selected parameters by specifying means and standard deviation sigmas of said selected parameters and causing a random draw to be performed on each of the selected parameters before executing a single run mode to collect statistics on the parameters and results from which a mean, standard deviation, minimum and maximum outcome for parameters derived from said selected parameters;

wherein the optimization mode determines a best mix of design parameters that optimize a naval gun system's combat effectiveness while satisfying specified performance requirements and resource constraints and selected from a user-defined set of design parameters, the optimization mode achieved by using special algorithms to pulse the causal network model until the design parameters converge to within predefined limits;

d) selectively sending the virtual representation to a virtual simulation system for simulating an operation of the naval gun system;

e) receiving information about the simulation of the operation of the naval gun system; and f) utilizing information about the simulation to enhance the virtual representation.

23. A method of integrated evaluation and simulation for allocating resources across a system architecture of an advanced naval gun system to optimize combat effectiveness of the naval gun system, comprising:

a) providing a computer system having a user interface and a computational engine factoring at least one interrelationship among a plurality of critical combat effectiveness functional attributes and constrained resources for the naval gun system, the combat effectiveness functional attributes including gun composition, propellant characteristics, projectile composition, projectile aerodynamic characteristics, and lethality;

b) selectively inputting data into the computational engine sufficient to create a virtual representation of at least one naval gun system;

c) calculating design parameters for a gun, a propellant, and a projectile of the at least one naval gun system;

d) calculating aerodynamic coefficients of the projectile;

e) calculating time of flight of the projectile;

f) providing at least one virtual simulation system;

g) simulating an operation of the naval gun system on the virtual simulation system;

h) calculating the system performance and system effectiveness of the naval gun system using the virtual simulation system by running the computational engine in a run mode selected from a group of run modes comprising a single run mode, a dependencies mode, a sensitivities mode, a Monte Carlo mode, and an optimizing mode, the single run mode performs a single iteration through the causal network model to produce a set of intermediate and final results, the single run mode permitting one or more input variables of a set to be changed during operation to compute and display a point solution for the set of input parameters;

wherein the mode rapidly and visually identifies at least one interrelationship between design attributes and performance parameters within the causal network model by computing and displaying downstream performance parameters affected upon a change to a user-selected upstream input value;

wherein the sensitivities mode evaluates weapon system performance in terms of one or more design parameters in the causal network model by providing for the computational engine to perform multiple single-run passes through the causal network, each single-run pass attended by a variation of an input design parameter over a specified range so as to evaluate effects of the variation of the input design parameter on at least one performance parameter;

wherein the Monte Carlo mode assesses a probability of meeting specified requirements by inserting user-selected technological and manufacturing uncertainty into an analysis to create an optimally combat effective virtual representation of the naval gun system, the Monte Carlo mode providing for user-defined variation of selected parameters by specifying means and standard deviation sigmas of said selected parameters and causing a random draw to be performed on each of the selected parameters before executing a single run mode to collect statistics on the parameters and results from which a mean, standard deviation, minimum and maximum outcome for parameters derived from said selected parameters;

wherein the optimization mode determines a best mix of design parameters that optimize a naval gun system's combat effectiveness while satisfying specified performance requirements and resource constraints and selected from a user-defined set of design parameters, the optimization mode achieved by using special algorithms to pulse the causal network model until the design parameters converge to within predefined limits; and i) utilizing information obtained from steps (b) through (g) to further enhance the virtual representation of the at least one naval gun system.

* * * * *

UNITED STATES PATENT AND TRADEMARK OFFICE

CERTIFICATE OF CORRECTION

PATENT NO. : 6,945,781 B2
DATED : September 20, 2005
INVENTOR(S) : John S. Perry et al.

It is certified that error appears in the above-identified patent and that said Letters Patent is hereby corrected as shown below:

Column 17,
Line 31, delete “identify” and insert -- identifies --.

Column 24,
Line 43, delete “perform” and insert -- performs --.

Column 27,
Line 8, before “the optimization”, insert -- wherein --.

Signed and Sealed this

Fourteenth Day of March, 2006

JON W. DUDAS
*Director of the United States Patent and Trademark Office*